US011508202B1

(12) United States Patent
Luberto et al.

(10) Patent No.: US 11,508,202 B1
(45) Date of Patent: Nov. 22, 2022

(54) MODULAR DISPLAY AND DISPENSING SYSTEM

(71) Applicant: Henschel-Steinau, Inc., Allendale, NJ (US)

(72) Inventors: Michael D. Luberto, River Vale, NJ (US); Michael D. DeSena, West Caldwell, NJ (US); Getachew Kassa, West Orange, NJ (US)

(73) Assignee: Henschel-Steinau, Inc., Allendale, NJ (US)

( * ) Notice: Subject to any disclaimer, the term of this patent is extended or adjusted under 35 U.S.C. 154(b) by 0 days.

(21) Appl. No.: 17/208,102

(22) Filed: Mar. 22, 2021

(51) Int. Cl.
*G07F 11/68* (2006.01)
*G07F 17/32* (2006.01)

(52) U.S. Cl.
CPC ..... *G07F 11/68* (2013.01); *G07F 17/329* (2013.01); *G07F 17/3216* (2013.01)

(58) Field of Classification Search
CPC ..... G07F 11/68; G07F 17/3216; G07F 17/329
See application file for complete search history.

(56) References Cited

U.S. PATENT DOCUMENTS 2,980,307 A * 4/1961 Crane ..... B65H 35/006 226/135
5,137,340 A * 8/1992 Cugley ..... A47B 87/02 312/234.5
5,287,980 A * 2/1994 Saltz ..... B65D 21/0204 220/636
7,134,673 B2 * 11/2006 Ferraro ..... A47B 87/0253 280/33.993
7,467,738 B2 * 12/2008 Woods ..... G07F 11/68 225/93
8,412,375 B2 * 4/2013 Schifman ..... G07F 17/0092 700/242
8,827,111 B2 * 9/2014 Johnson ..... A47F 1/087 221/124
8,833,601 B2 * 9/2014 Zacherle ..... B65D 71/36 221/30
10,860,275 B1 * 12/2020 Luberto ..... G06F 3/1446
10,905,256 B2 * 2/2021 Johnson ..... A47F 7/28
11,107,311 B2 * 8/2021 Mejenborg ..... G07F 11/18
2001/0032035 A1 * 10/2001 Holmes ..... A47B 88/994 700/231
2005/0178810 A1 * 8/2005 Woods ..... G07F 11/68 225/1
2005/0184081 A1 * 8/2005 Jensen ..... G07B 3/00 221/33

(Continued)

*Primary Examiner* — Michael Collins
(74) *Attorney, Agent, or Firm* — Richard M. Goldberg

(57) ABSTRACT

A modular display and dispensing assembly for the sale of items, includes a base adapted to be securely mounted to a substrate at a prescribed display and dispensing location on the substrate; and at least one display and dispensing module for mounting on the base, each display and dispensing module including a housing for mounting on the base, and a drawer for holding the items for sale, the drawer adapted to be removably positioned and secured in the housing for dispensing the items for sale while the drawer is secured in the housing, each drawer including a first lengthwise divider for varying at least one widthwise compartment size in the drawer and a second widthwise divider for varying at least one lengthwise compartment size in the drawer, for holding different size items for sale.

16 Claims, 31 Drawing Sheets

(56) References Cited

U.S. PATENT DOCUMENTS

| | | | | |
|---|---|---|---|---|
| 2007/0085456 | A1* | 4/2007 | Farrens | A47B 49/00 312/321.5 |
| 2008/0042534 | A1* | 2/2008 | Mallouk | A47B 87/0292 312/309 |
| 2008/0245813 | A1* | 10/2008 | Johnson | A47F 5/0018 221/194 |
| 2009/0159610 | A1* | 6/2009 | Woods | G07F 11/68 221/45 |
| 2010/0308071 | A1* | 12/2010 | Businger | G07F 17/42 221/46 |
| 2012/0203376 | A1* | 8/2012 | Savage | B25H 3/06 700/214 |
| 2012/0262039 | A1* | 10/2012 | Daugbjerg | A61G 12/001 312/249.11 |
| 2014/0265802 | A1* | 9/2014 | Wilcox | F25D 25/025 312/404 |
| 2020/0095053 | A1* | 3/2020 | Mejenborg | G07F 17/42 |
| 2020/0098225 | A1* | 3/2020 | Ghia | G07B 7/00 |
| 2021/0110630 | A1* | 4/2021 | Mejenborg | G07F 17/3202 |

* cited by examiner

MODULAR DISPLAY AND DISPENSING SYSTEM

BACKGROUND OF THE INVENTION

The present invention relates generally to the display and dispensing of a variety of items at a sales counter or the like and pertains, more specifically, to the presentation of a selected variety of items displayed at a particular location such as, for example, a sales counter where a customer can view and select available items for retrieval by a sales clerk, with increased ease and convenience.

Many items are offered for sale at display locations on counters and similar sales points at retail outlets where a customer can select a particular item and a sales clerk retrieves the chosen item from the display and delivers the item to the customer. For example, lottery tickets are sold in that manner, requiring careful control over inventory and sales. At the same time, a wide variety of items are made available in a limited space, requiring a compact display. Additionally, higher valued items, such as lottery tickets, must be protected against theft while still being offered in an aesthetically attractive display.

U.S. Pat. No. 10,860,275, to the same applicant herein, and the entire disclosure of which is incorporated herein by reference, discloses a modular display and dispensing system that satisfies the above requirements. However, this system has some drawbacks.

Specifically, it is desirable to provide adjustability for different size items. For example, lottery tickets come in different sizes, and rather than providing different size drawers for each size lottery ticket, it is desirable to provide a single drawer that can accommodate different size lottery tickets.

In addition, it is desirable to provide an inexpensive, relatively simple replaceable display in front of a drawer corresponding to the item in the drawer, for displaying a sample of the items contained in the drawer. For example, it is desirable to provide a sample lottery ticket at the front of the drawer containing the same type of lottery ticket, with the sample lottery ticket being easily replaceable if different lottery tickets are placed in the drawer.

SUMMARY OF THE INVENTION

Recognizing the above factors, as well as additional requirements, the present invention attains several objects and advantages.

It is an object of the present invention to provide a modular display and dispensing system that overcomes the aforementioned problems.

It is another object of the present invention to provide a modular display and dispensing system that permits adjustability for different size items therein.

It is still another object of the present invention to provide a modular display and dispensing system with an inexpensive, relatively simple replaceable display at the front of a drawer corresponding to the items in the drawer.

It is yet another object of the present invention to provide a compact and versatile modular display and dispensing system available at counters and similar retail sales locations for selection by a purchaser and delivery to the purchaser by a sales clerk.

It is a further object of the present invention to provide a modular display and dispensing system that facilitates the assembly of a selected number of display and dispensing modules into a matrix of selected modules readily placed at a sales location.

In accordance with an aspect of the present invention, a modular display and dispensing assembly for the sale of items, includes a base adapted to be securely mounted to a substrate at a prescribed display and dispensing location on the substrate; and at least one display and dispensing module for mounting on the base. Each display and dispensing module includes a housing for mounting on the base, and a drawer for holding the items for sale, the drawer adapted to be removably positioned and secured in the housing for dispensing the items for sale while the drawer is secured in the housing. Each drawer includes at least one adjustable divider for varying at least one compartment size in the drawer for holding different size items for sale.

The at least one adjustable divider includes a first divider for providing that the drawer includes either a single compartment, or two compartments separated by the first divider. The first divider extends in a lengthwise direction of the drawer.

Specifically, the first divider is pivotally mounted in the drawer for movement between a first position in which the first divider is positioned upright and divides the single compartment into two separate compartments, and a second position in which the first divider is pivoted down over a bottom wall of the drawer to provide a single large compartment in the drawer.

To this end, the drawer includes a recess, and the first divider includes a divider plate and a pivot rod connected to one end of the divider plate, with the pivot rod rotatably mounted in the recess for permitting pivotal movement of the first divider between the first position and the second position. A restraining member is provided for limiting pivotal movement of the first divider to the first position.

The at least one adjustable divider further includes a second divider extending transversely of the drawer for adapting to different length items in the drawer. The second divider extends transversely of the first divider and is adapted to engage with the first divider when the first divider is in the first upright position. The second divider can be used without the first divider.

When used together, the first divider includes a plurality of slots extending down from an upper surface thereof, and the second divider includes at least one slot extending up from a lower surface thereof for engaging with one of the slots of the first divider to position the second divider in one of a plurality of positions along the first divider.

Preferably, the first divider extends in a lengthwise direction of the drawer, and the second divider extends in a transverse direction of the drawer.

The second divider includes a plurality of serrations along a surface thereof for aiding in separation of the items to be dispensed from the drawer while the drawer is secured in the housing. The second divider also includes at least one ramp at a lower end thereof for aiding in the removal of the items from the drawer.

The drawer includes opposite side walls having a plurality of aligned, vertically extending slots for receiving side edges of the second divider therein. In addition, each side edge of the second divider includes a retaining tab at an upper end thereof, and the drawer includes deeper recesses above the vertically extending slots for receiving the retaining tabs therein to releasably lock the second divider to the drawer at a desired position.

Preferably, the items for sale are end to end connected lottery tickets which are adapted to be removed through a gap between the drawer and the housing when the drawer is secured in the housing.

In accordance with another aspect of the present invention, a modular display and dispensing assembly for the sale of items, includes a base adapted to be securely mounted to a substrate at a prescribed display and dispensing location on the substrate; and at least one display and dispensing module for mounting on the base. Each display and dispensing module includes a housing for mounting on the base; and a drawer for holding the items for sale, the drawer adapted to be removably positioned and secured in the housing for dispensing the items for sale while the drawer is secured in the housing. Each housing includes a display card holder at a front end thereof for removably holding a display card corresponding to the items for sale in the drawer. The display card holder includes a holding arrangement for removably holding the display card at the front end of the housing; and a transparent cover movable between a first position over the display card holder for viewing the display card and a second position away from the display card holder for removing a display card therefrom and positioning a different display card therein, the transparent cover being removably mounted to the housing.

The display card holder includes a surface against which the display card is adapted to be positioned and tabs for removably holding the display card thereat.

The transparent cover is pivotally mounted to the housing for movement between the first and second positions.

The transparent cover includes at least one tab for removably engaging with the housing to hold the transparent cover in the first position.

The above and other features of the invention will become readily apparent from the following detailed description thereof which is to be read in connection with the accompanying drawings.

BRIEF DESCRIPTION OF THE DRAWINGS

The invention will be understood more fully, while still further objects and advantages will become apparent, in the following detailed description of preferred embodiments of the invention illustrated in the accompanying drawing, in which.

DETAILED DESCRIPTION

Figure 1:
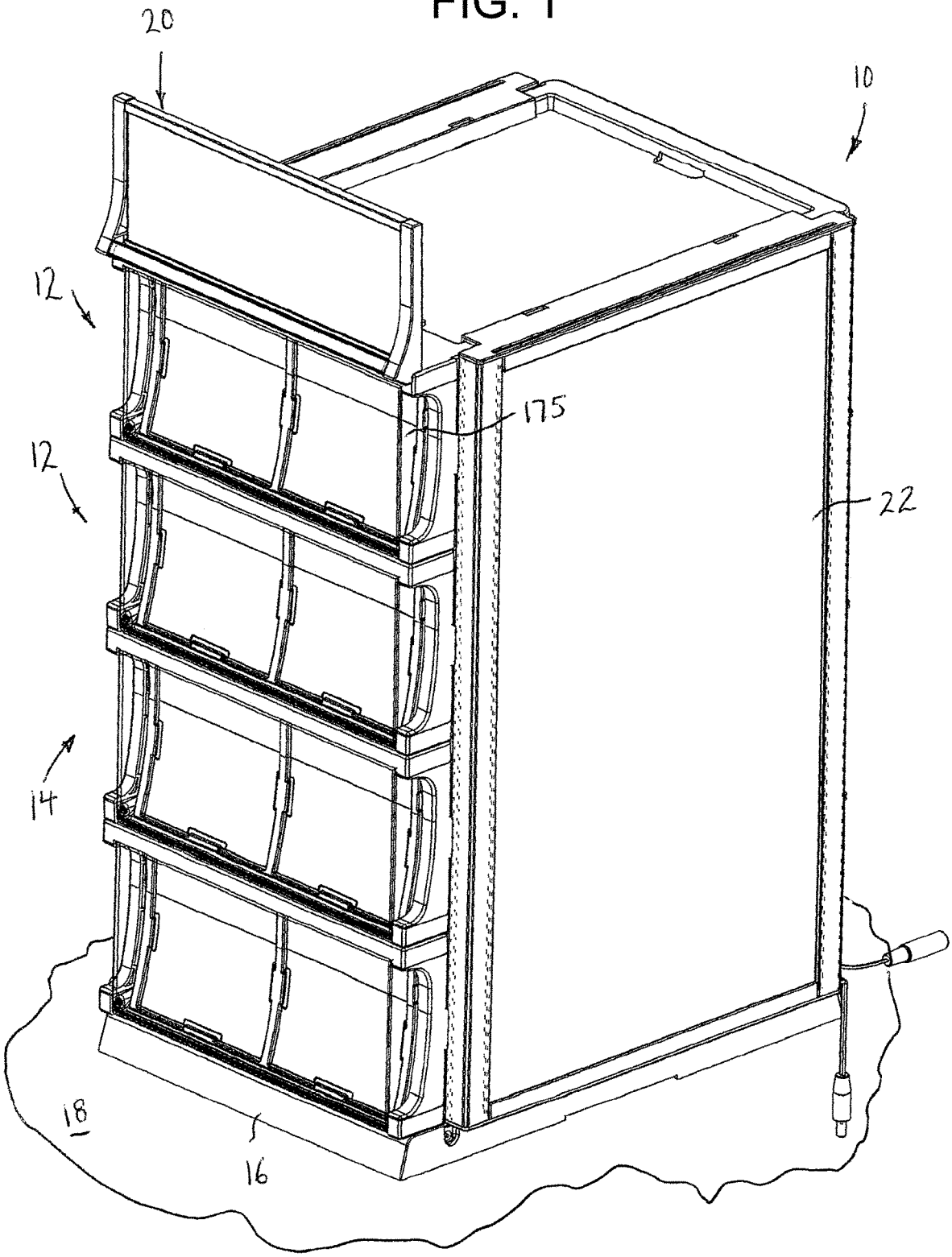
FIG. 1 is a front, top perspective view of a matrix of display and dispensing modules in a modular display and dispensing assembly in accordance with the present invention.
Figure 2:
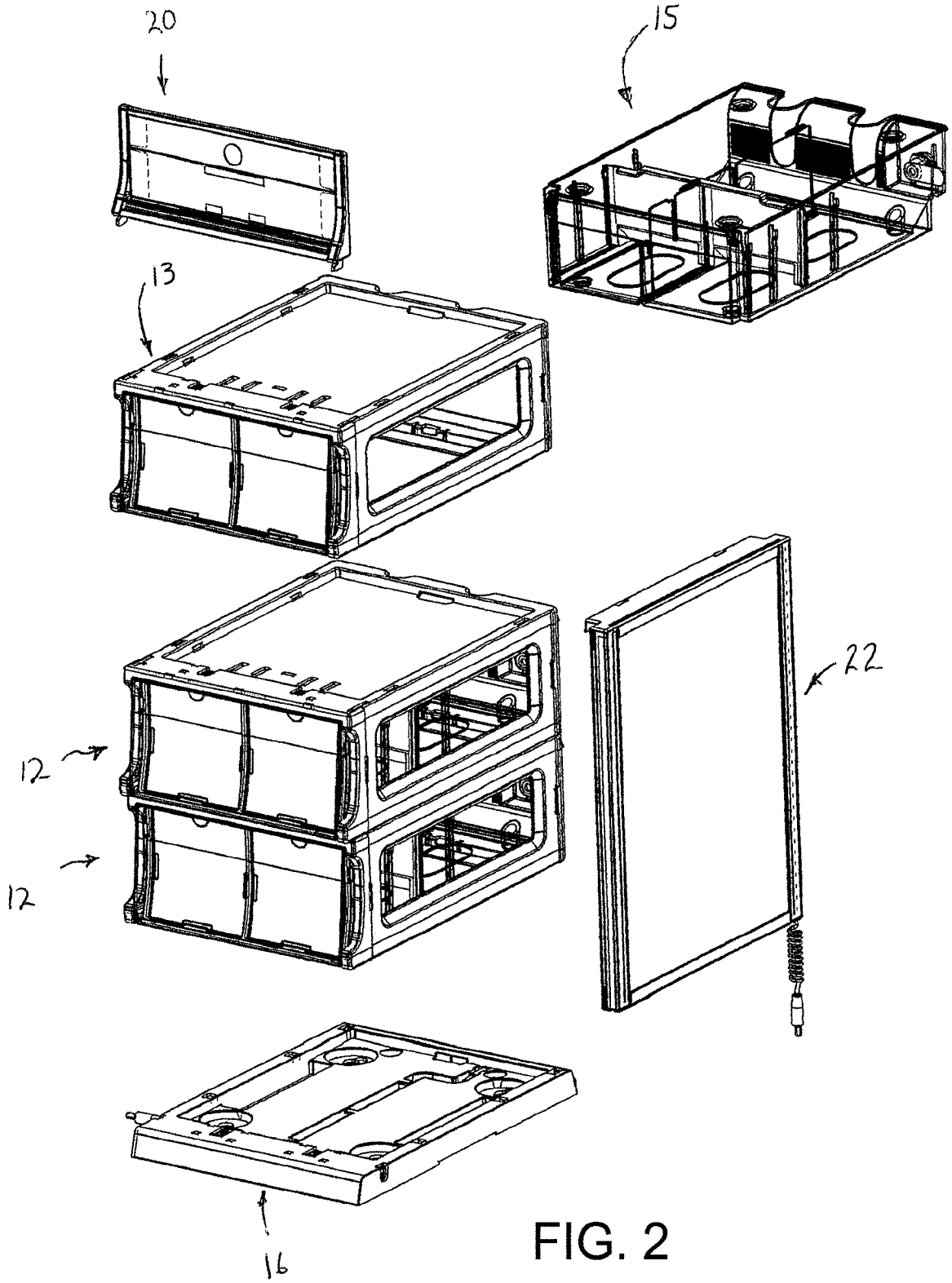
FIG. 2 is exploded perspective view of the matrix of FIG. 1.

Referring to the drawings, and initially to FIGS. 1 and 2, a modular display and dispensing assembly 10 in accordance with the present invention includes a plurality of display and dispensing modules 12 connected with each other and arranged in a column 14 upon a base 16 supported on a substrate shown in the form of a counter 18 within a retail sales venue. In the illustrated embodiment, the column 14 is comprised of four modules 12 which have been selected and arranged in a vertical orientation in a stack in the column 14, mounted on base 16, although the present invention is not limited to four modules.

Modular display and dispensing assembly 10 further includes a header display 20 for electronically displaying information pertaining to items to be dispensed from modules 12. This can occur by LEDs or another low-voltage electrical display feature provided in header display 20. A more detailed description of header 20 is provided in the aforementioned U.S. Pat. No. 10,860,275, the entire disclosure of which is incorporated herein.

Modular display and dispensing assembly 10 further includes a side panel display 22 mounted at each side of the joined stack of modules 12. Each side panel display 22 carries a low-voltage electrical display feature, such as illumination provided by LEDs, powered through a side panel connector circuit including electrical connectors configured for engagement with corresponding complementary electrical connectors connected by leads to a line cord, through a printed circuit board. A more detailed description of side panel display 22 is provided in the aforementioned U.S. Pat. No. 10,860,275, the entire disclosure of which is incorporated herein.

As shown best in FIGS. 2-5, base 16 includes a rectangular top wall 24 and four downwardly extending sidewalls 26*a*-26*d* at side edges of rectangular top wall 24 for supporting base 16 on counter 18.

A large rectangular recess 28 is formed in rectangular top wall 24, and is defined by four sidewalls 30*a*-30*d* extending downwardly from the inner edges of rectangular top wall 24, and connected at the lower edges thereof by a bottom wall 32 which is spaced above the lower edges of sidewalls 26*a*-26*d*. Rectangular recess 28, as will be discussed thereafter, is adapted to receive a display and dispensing module 12 therein.

Base 16 can be mounted to counter 18 in a permanent manner or removable manner. To this end, four recessed cups 34 are formed in bottom wall 32, with each recessed cup 34 having a bottom wall 36 with an opening 38 for receiving a screw to permanently secure base 16 to counter 18. Alternatively, in order to removably secure base 16 to counter 18, four additional recessed cups 40 are formed in bottom wall 32, each with a bottom wall 42 including a key shaped opening 44 having an enlarged opening section 46 which leads to a narrower opening section 48. In this manner, the head of a bolt secured to counter 18 can be inserted through enlarged opening section 46 and then slid over narrower opening section 48 to removably secure base 16 to counter 18. Of course, when the heads of the bolts are slid over narrower opening sections 48, the bolts can then be tightened in this position, if desired. Rectangular top wall 24 further includes at least one elongated recess 50 for holding at least one electrical line.

Figure 3:
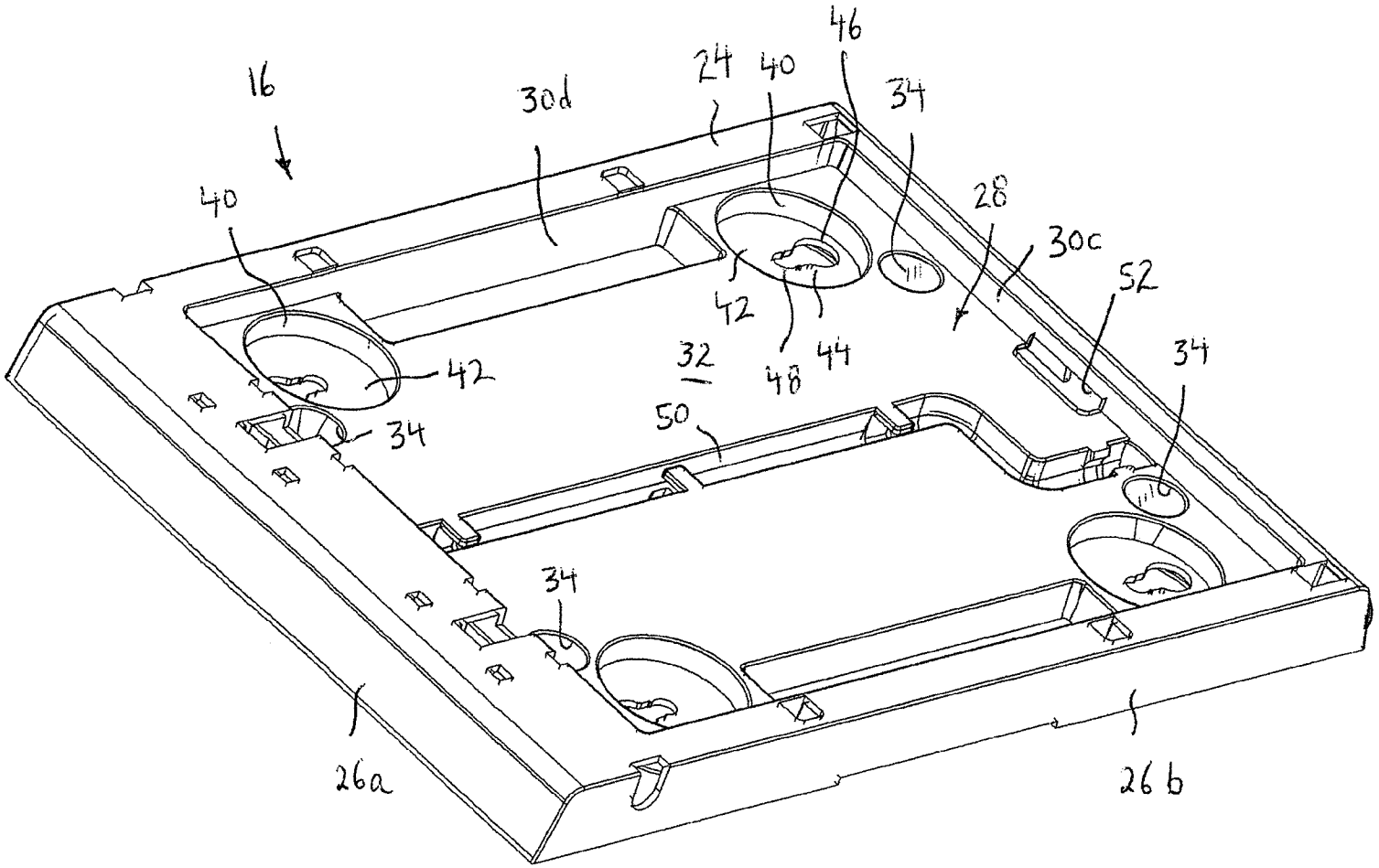
FIG. 3 is a front, top perspective view of the base to be secured to a counter.
Figure 4:
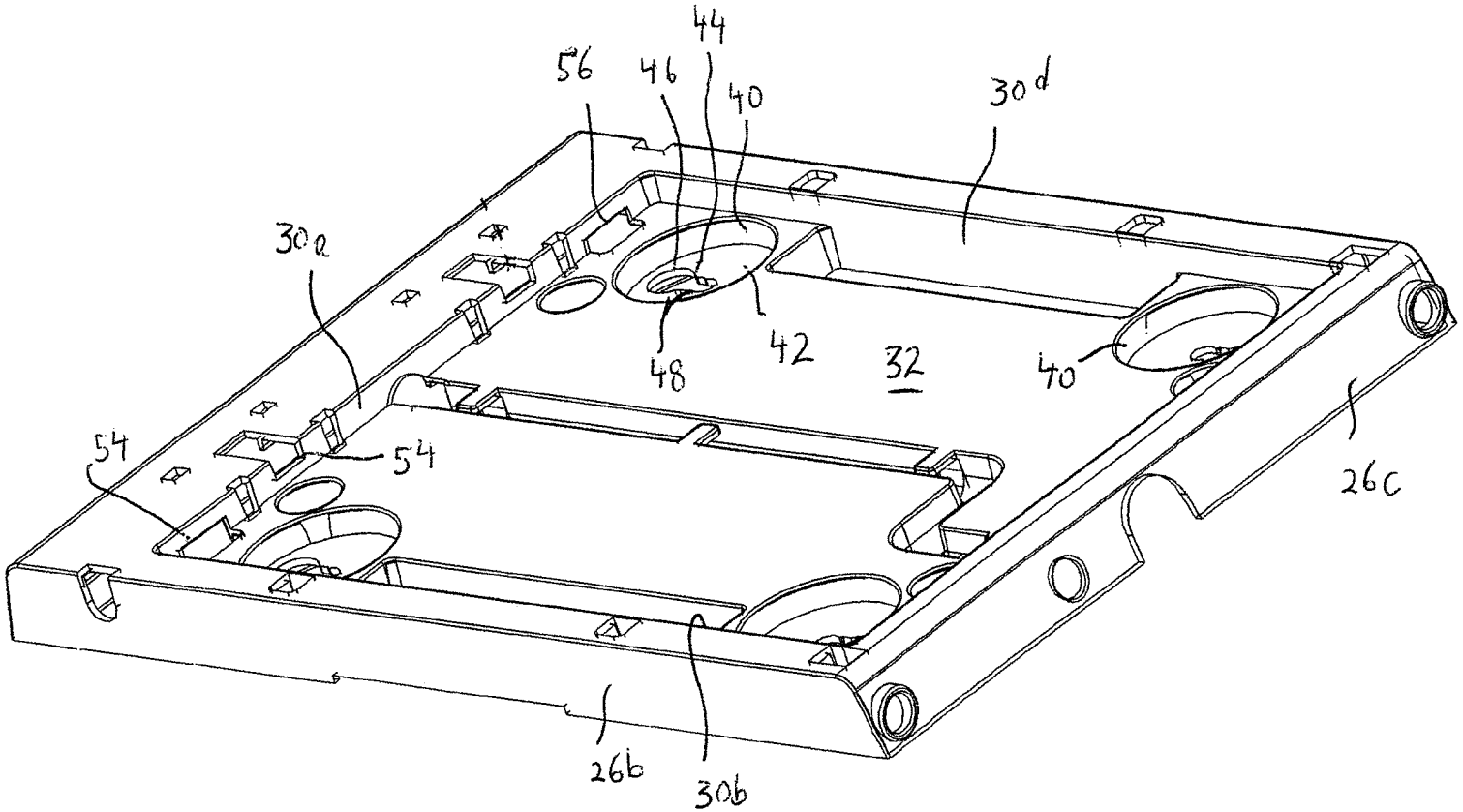
FIG. 4 is a rear, top perspective view of the base.
Figure 5:
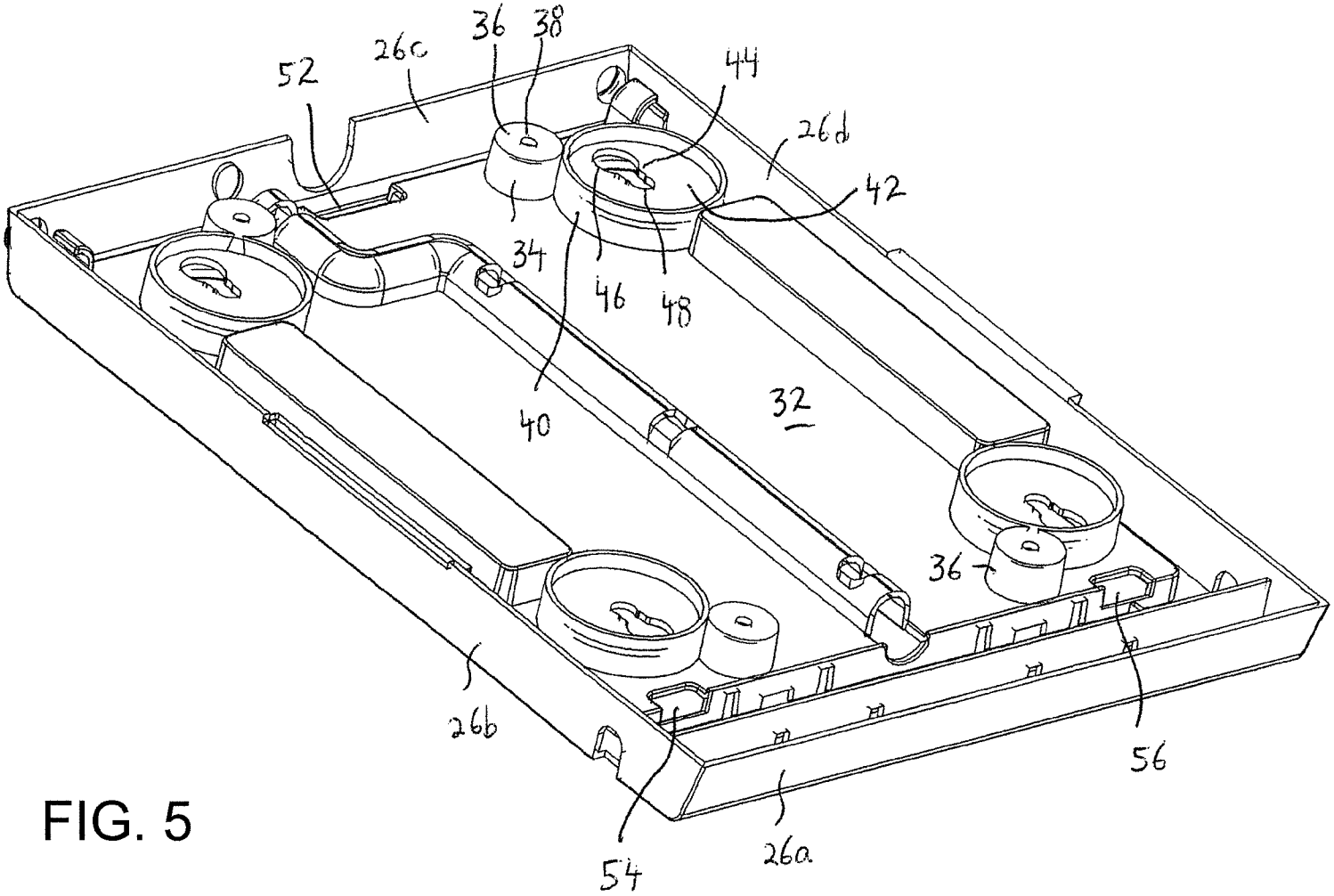
FIG. 5 is a bottom perspective view of the base.
Figure 6:
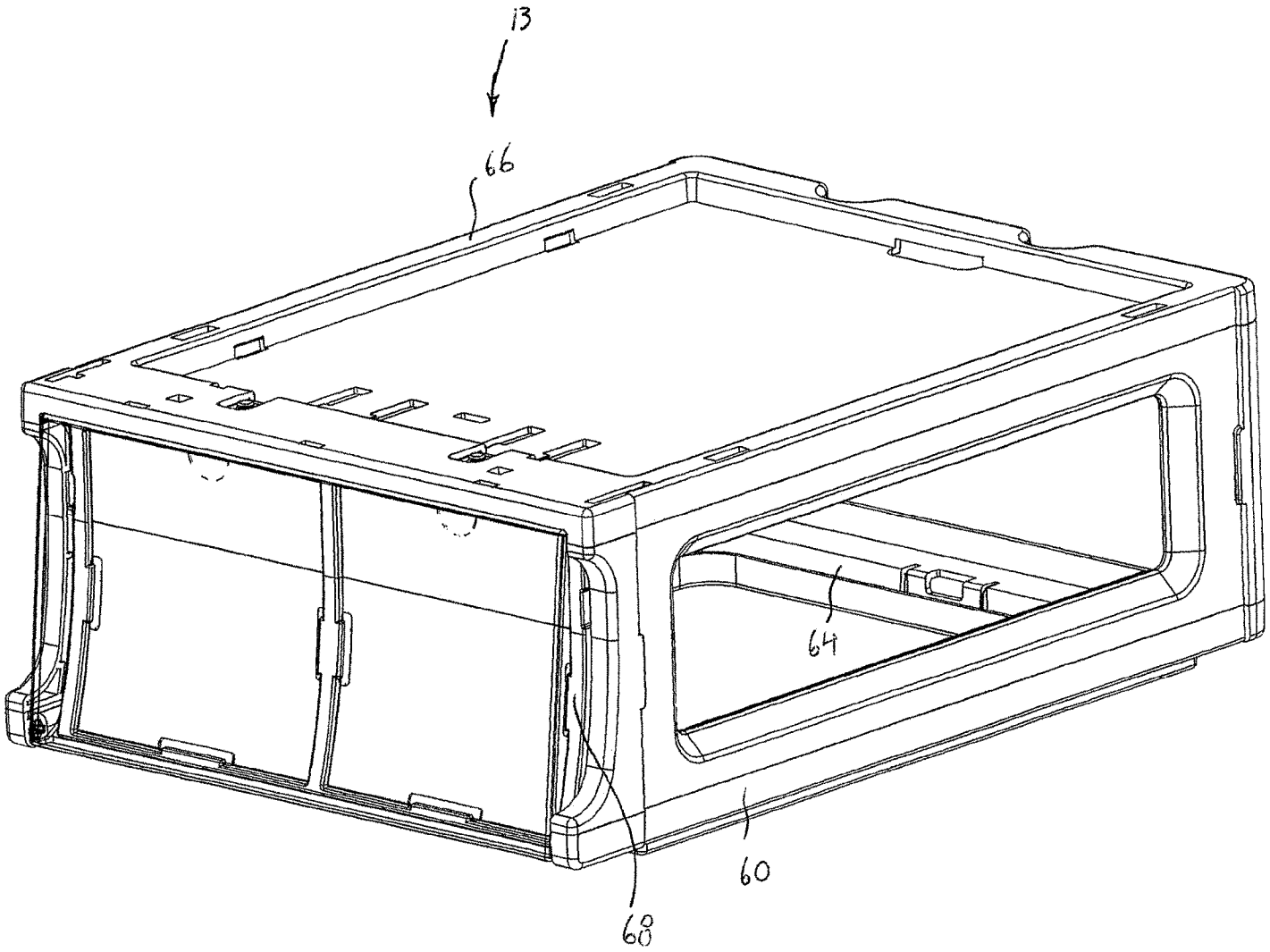
FIG. 6 is a front, top perspective view of the modular housing unit of one display and dispensing module.
Figure 7:
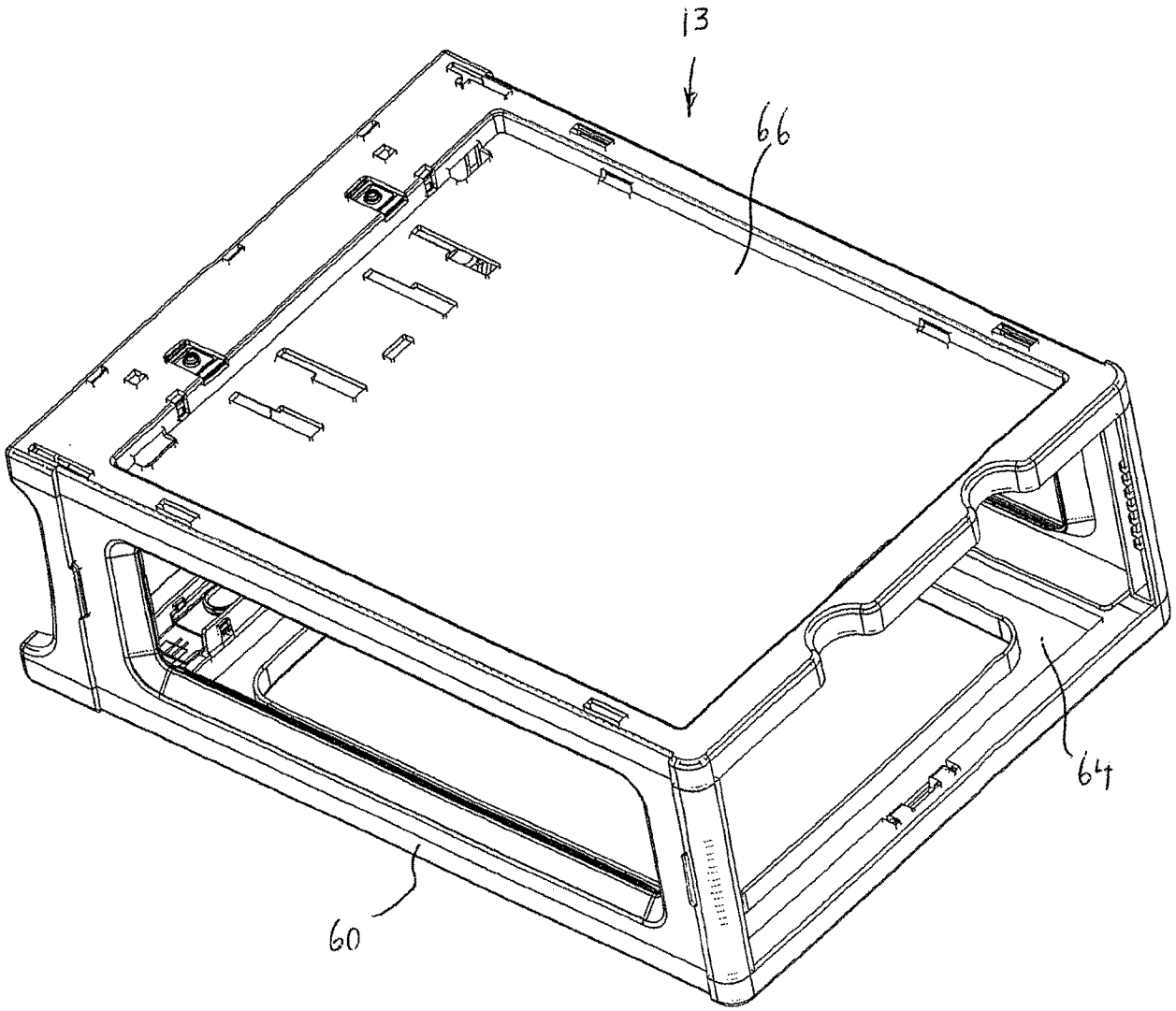
FIG. 7 is a rear, top perspective view of the modular housing unit.
Figure 8:
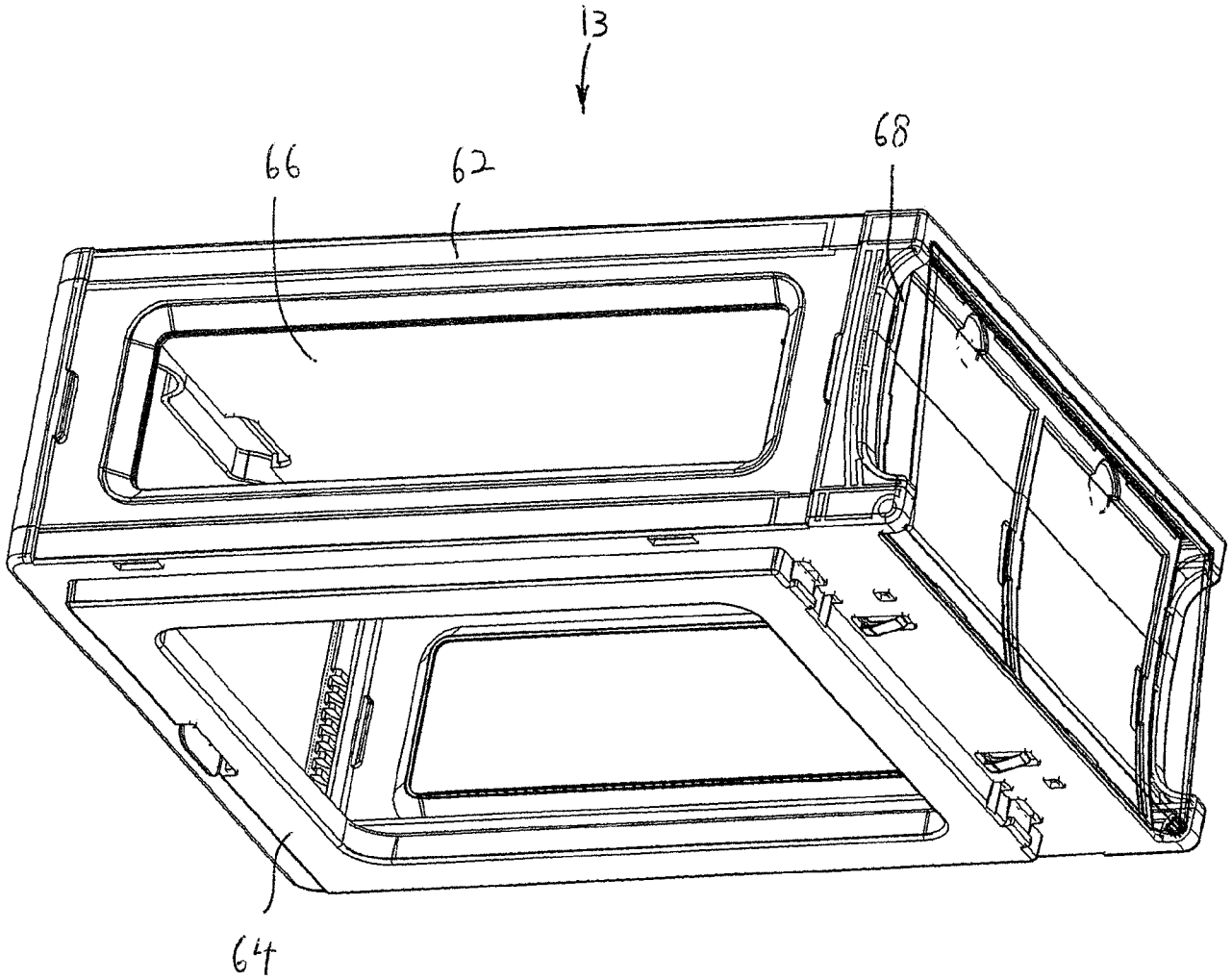
FIG. 8 is a front, bottom perspective view of the modular housing unit.
Figure 9:
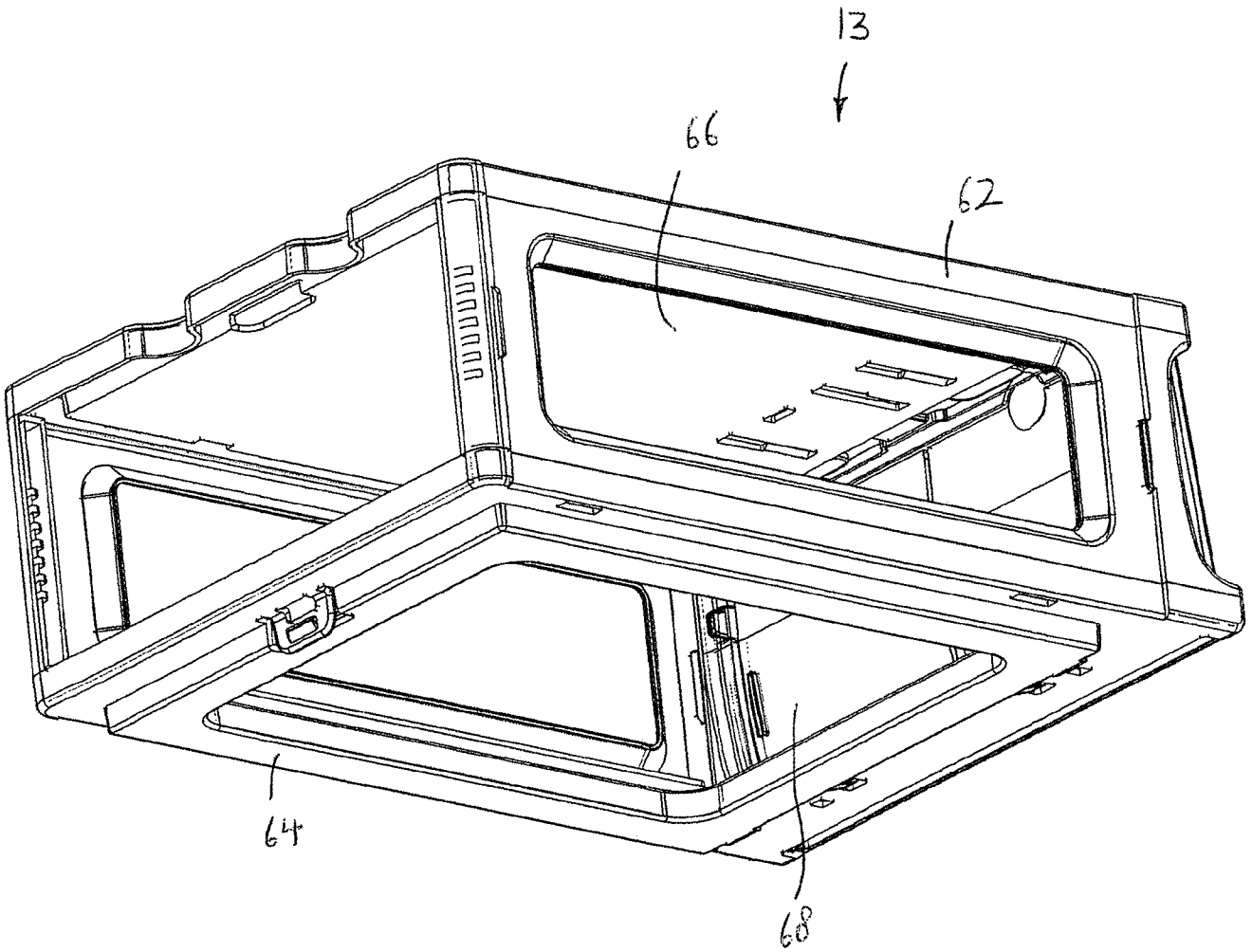
FIG. 9 is a rear, bottom perspective view of the modular housing unit.
Figure 10:
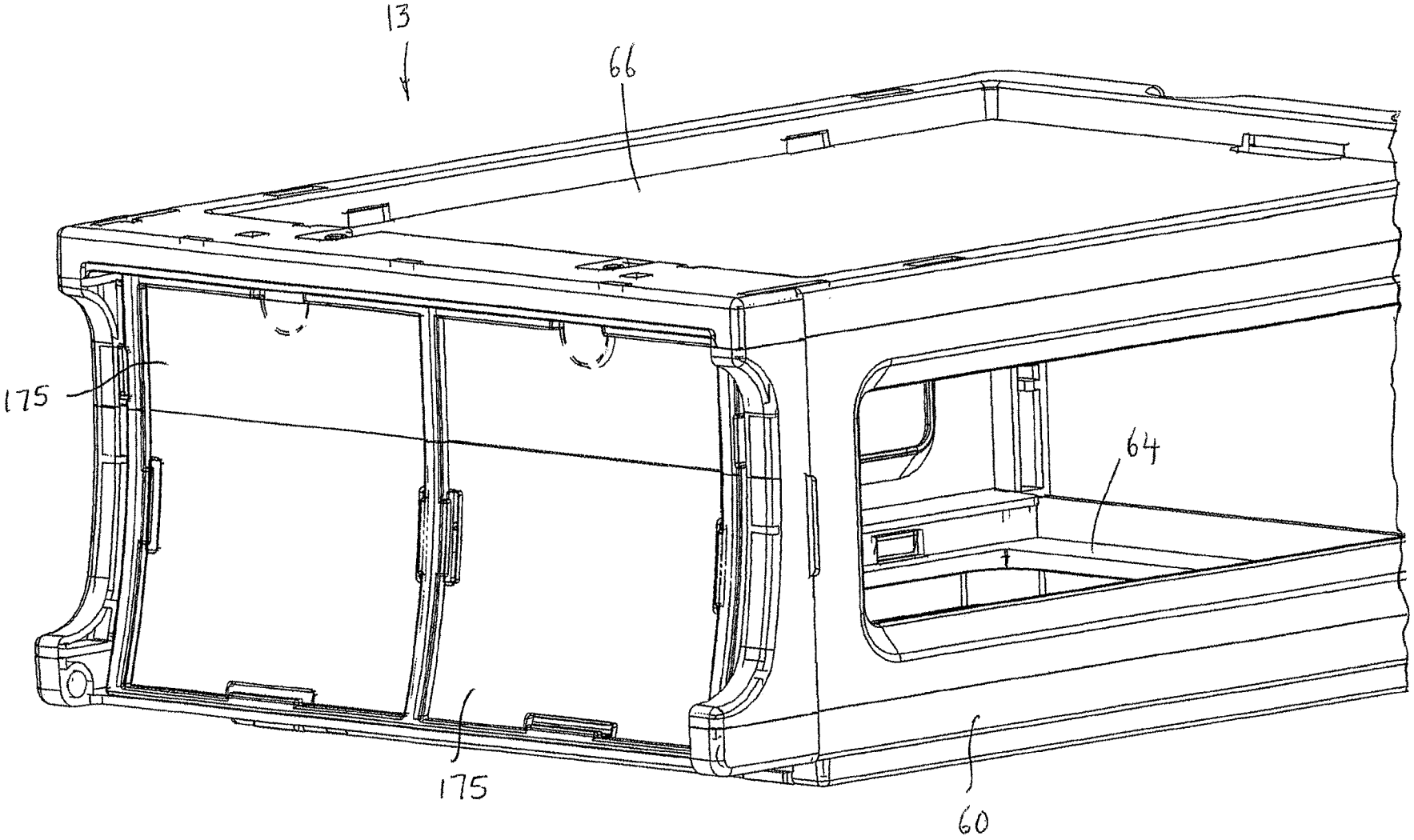
FIG. 10 is an enlarged front perspective view of the modular housing unit.
Figure 11:
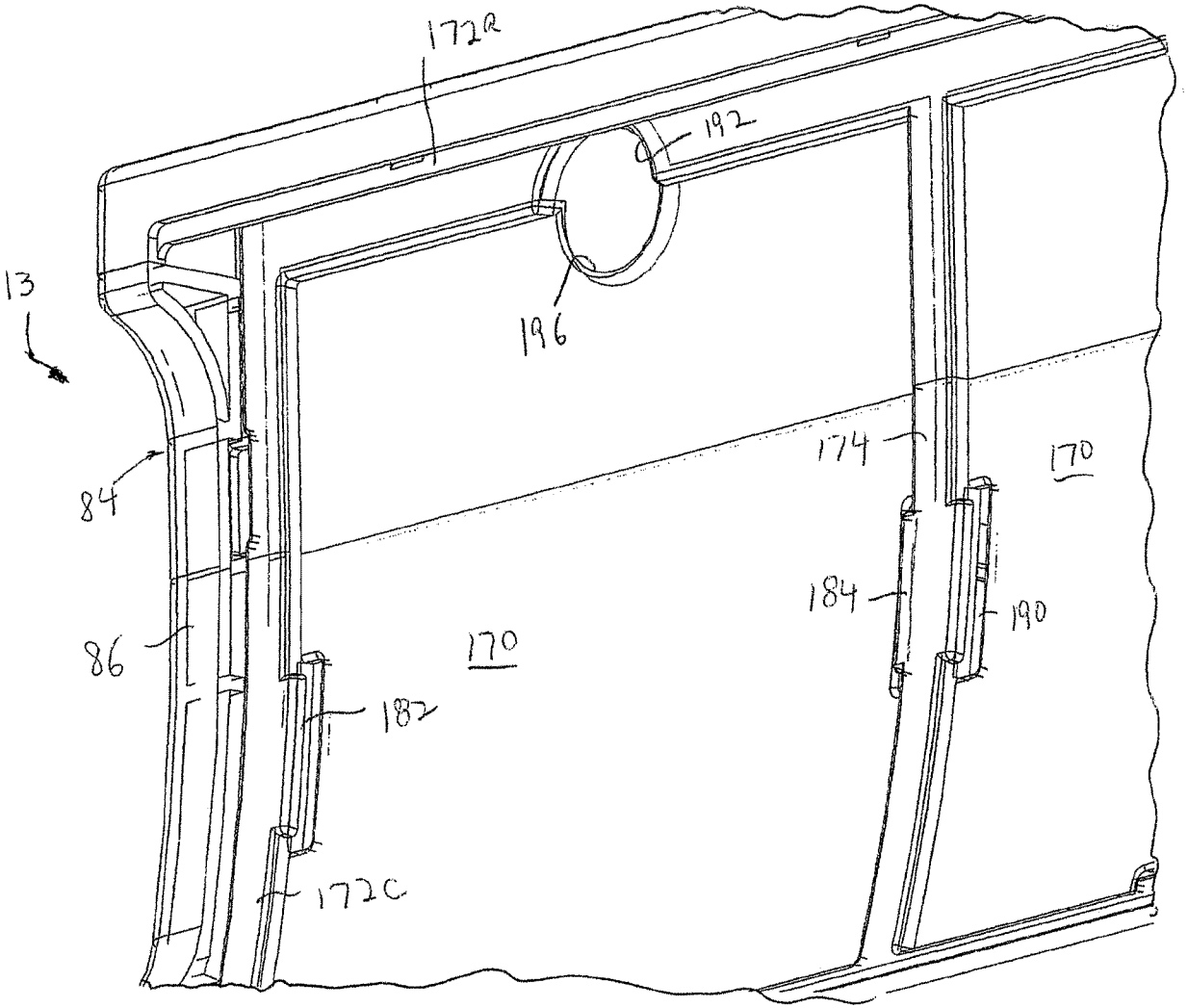
FIG. 11 is a further enlarged front perspective view of the module housing unit.

As shown best in FIGS. 3-5, a first L-shaped cutaway 52 is formed centrally of bottom wall 32 and downwardly extending side wall 30*c*, and second and third L-shaped cutaways 54 and 56 are formed in spaced apart relation of bottom wall 32 and downwardly extending side wall 30*a*. As will be appreciated from the discussion hereafter, cutaways 52, 54 and 56 are provided for securing the lower end of a display and dispensing module 12 within large rectangular recess 28.

Referring now to the remaining drawings, a display and dispensing module 12 will now be discussed.

Specifically, each module 12 includes a housing 13 and a drawer 15 slidably removable with respect to a respective housing 13.

As shown in FIGS. 2 and 6-11, housing 13 includes first and second spaced apart, parallel side panels 60 and 62, which are connected at their lower ends by a bottom panel 64, at the upper ends by a top panel 66 and at their front ends by a ticket frame or display card holder 68. It will be understood that side panels 60 and 62 are mirror images of each other, and accordingly, only one side panel 60 is described in detail hereafter.

Figure 12:
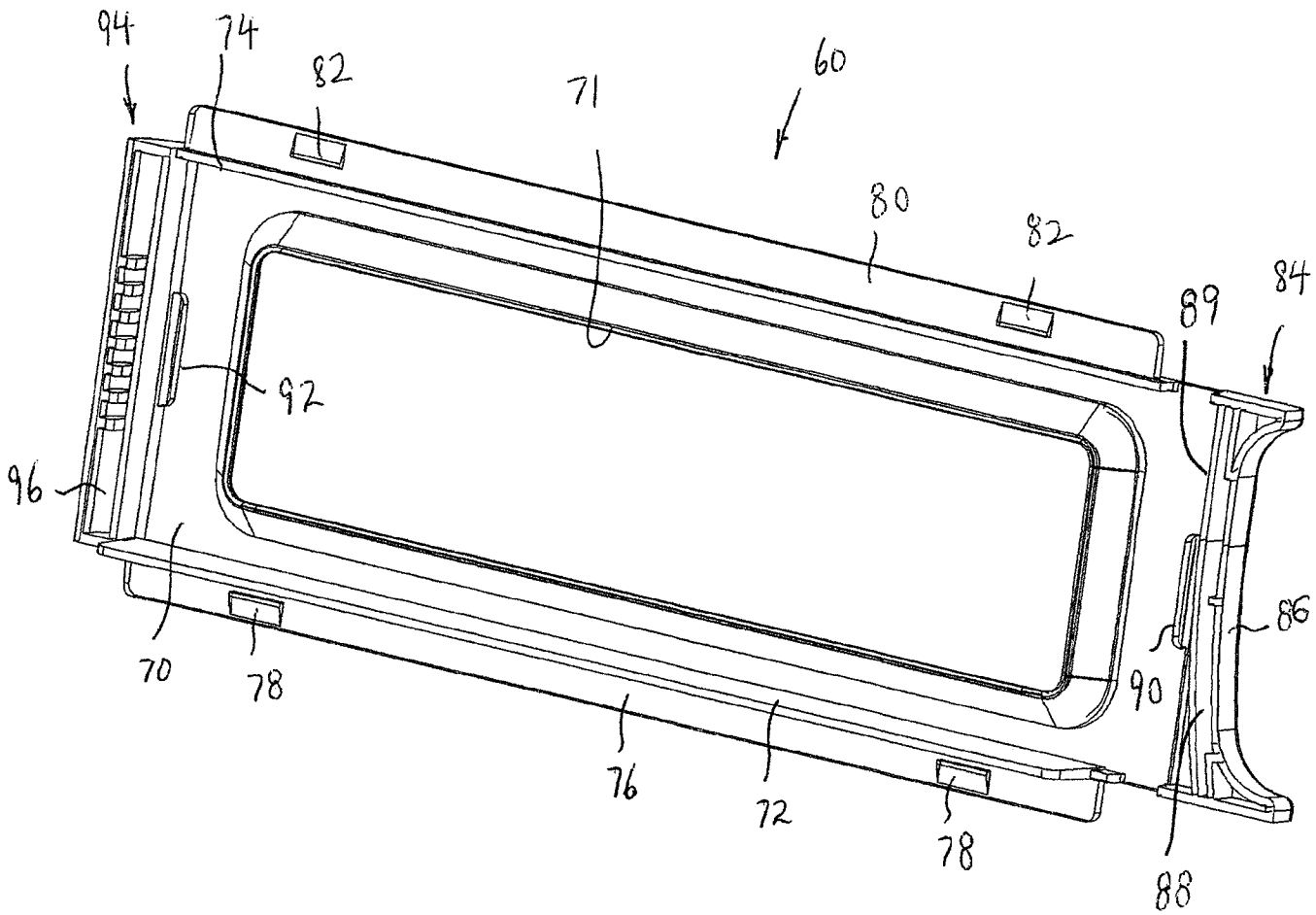
FIG. 12 is a perspective view of one side panel of the module housing unit.

As shown best in FIG. 12, side panel 60 has a generally elongated rectangular wall 70 with a large central rectangular opening 71 therein. A lower tray guiding ledge 72 extends inwardly from the lower edge of rectangular wall 70, and an upper tray guiding ledge 74 extends inwardly from the upper edge of rectangular wall 70. A lower retaining wall 76 of a slightly shorter length than rectangular wall 70 extends downwardly from the lower edge of rectangular wall 70 in parallel relation thereto and includes two spaced apart, triangular-shaped retaining walls 78 on the inner surface thereof below lower ledge 72. In like manner, an upper retaining wall 80 of a slightly shorter length than rectangular wall 70 extends upwardly from the upper edge of rectangular wall 70 in parallel relation thereto and includes two spaced apart, triangular-shaped retaining walls 82 on the inner surface thereof above upper ledge 74.

The front end of rectangular wall 70 has a front wall extension 84 extending forwardly of rectangular wall 70 and having an arcuate, concave forward facing wall 86. A vertically oriented, slightly arcuate recess 88 is provided on the inner surface of front wall extension 84 and is defined by a slightly arcuate retaining wall 89 and arcuate, concave forward facing wall 86.

A vertically oriented slot 90 is provided at the inner surface of rectangular wall 70 immediately rearwardly of the front edge thereof. A similar vertically oriented slot 92 is provided at the inner surface of rectangular wall 70 immediately forwardly of the rear edge thereof.

The rear end of side wall 60 has a rear wall extension 94 extending rearwardly of rectangular wall 70, and having a vertically oriented opening 96 provided on the inner surface thereof.

Figure 13:
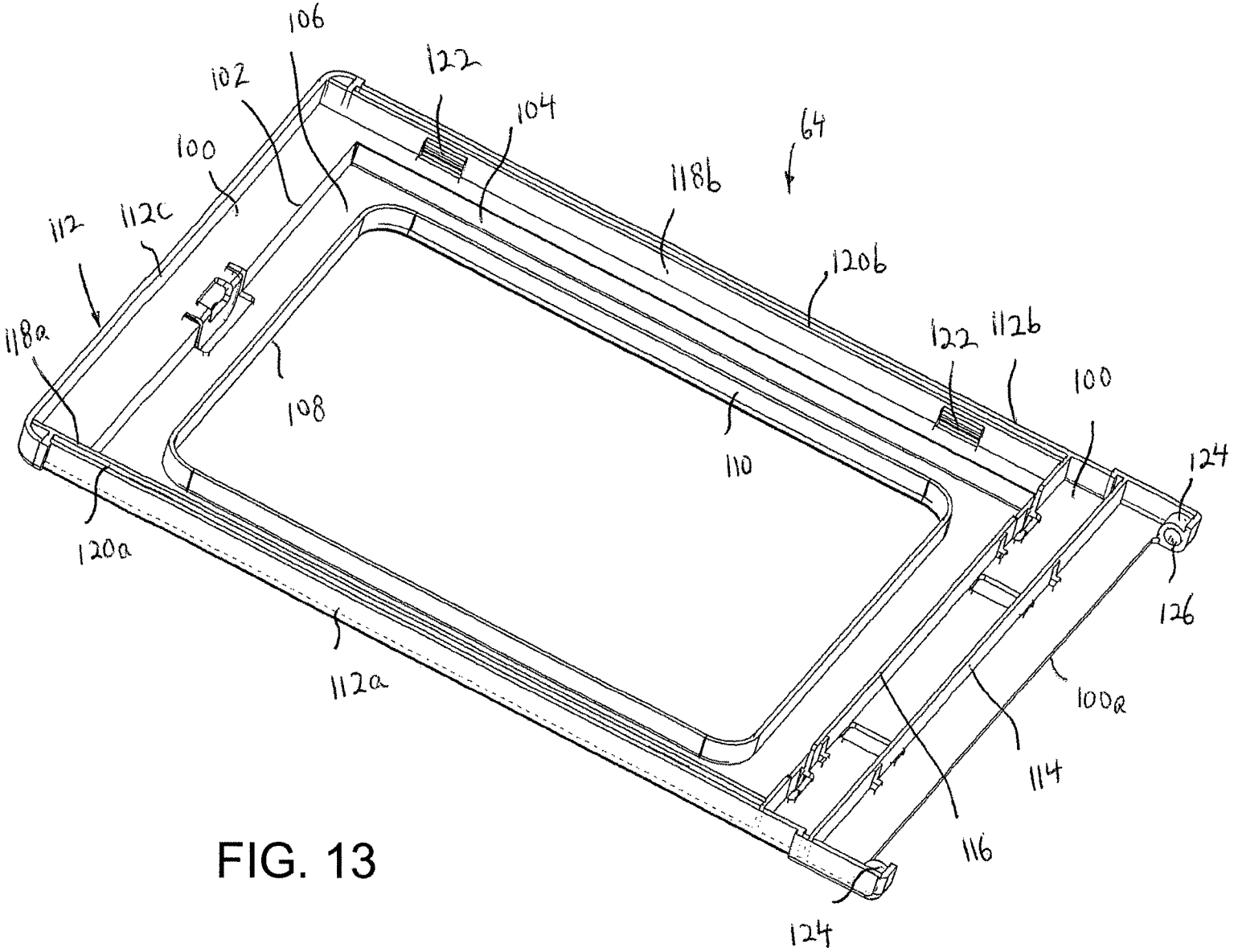
FIG. 13 is a front, top perspective view of the bottom panel of the modular housing unit.
Figure 14:
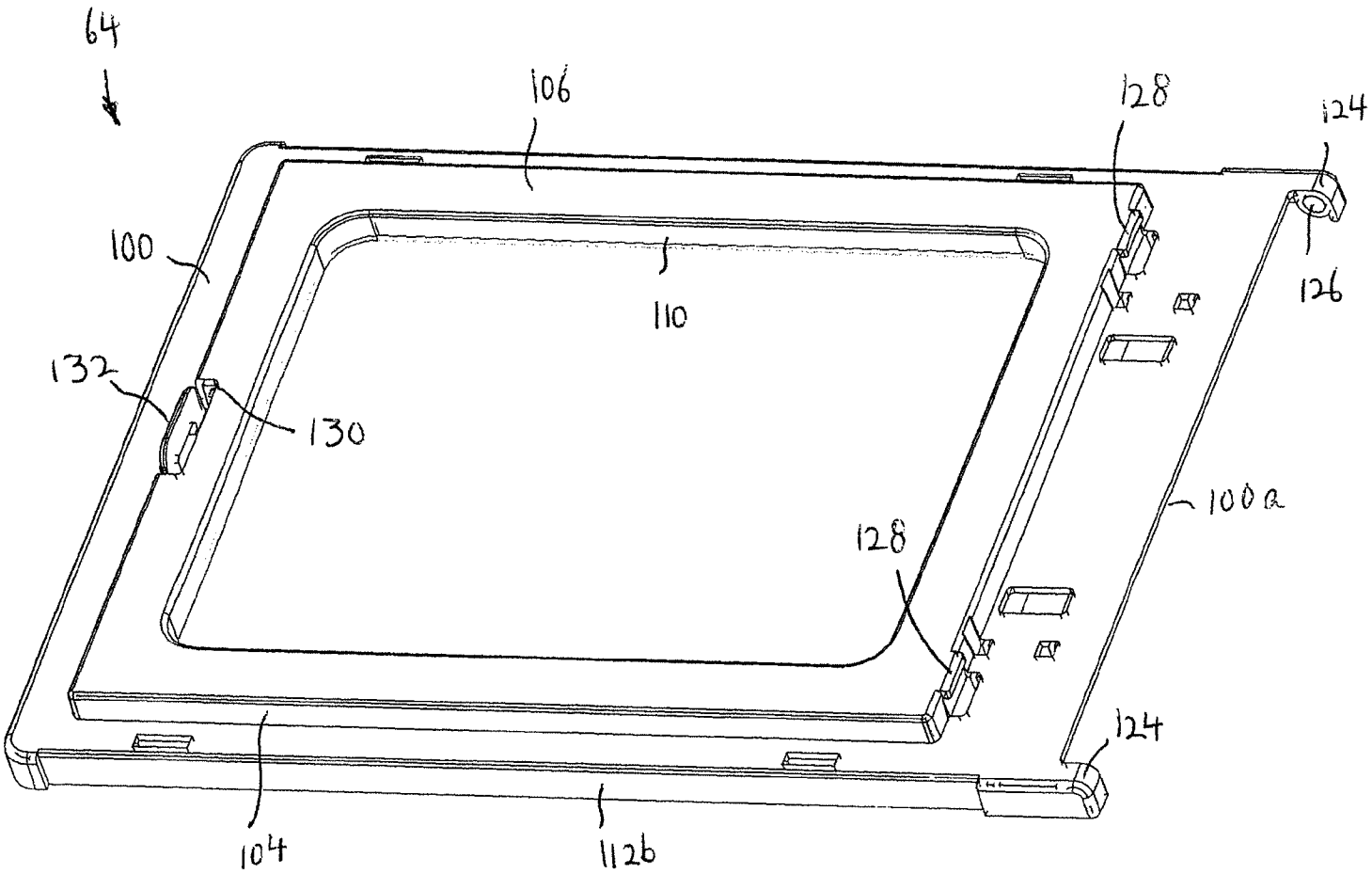
FIG. 14 is a front, bottom perspective view of the bottom panel of the modular housing unit.
Figure 15:
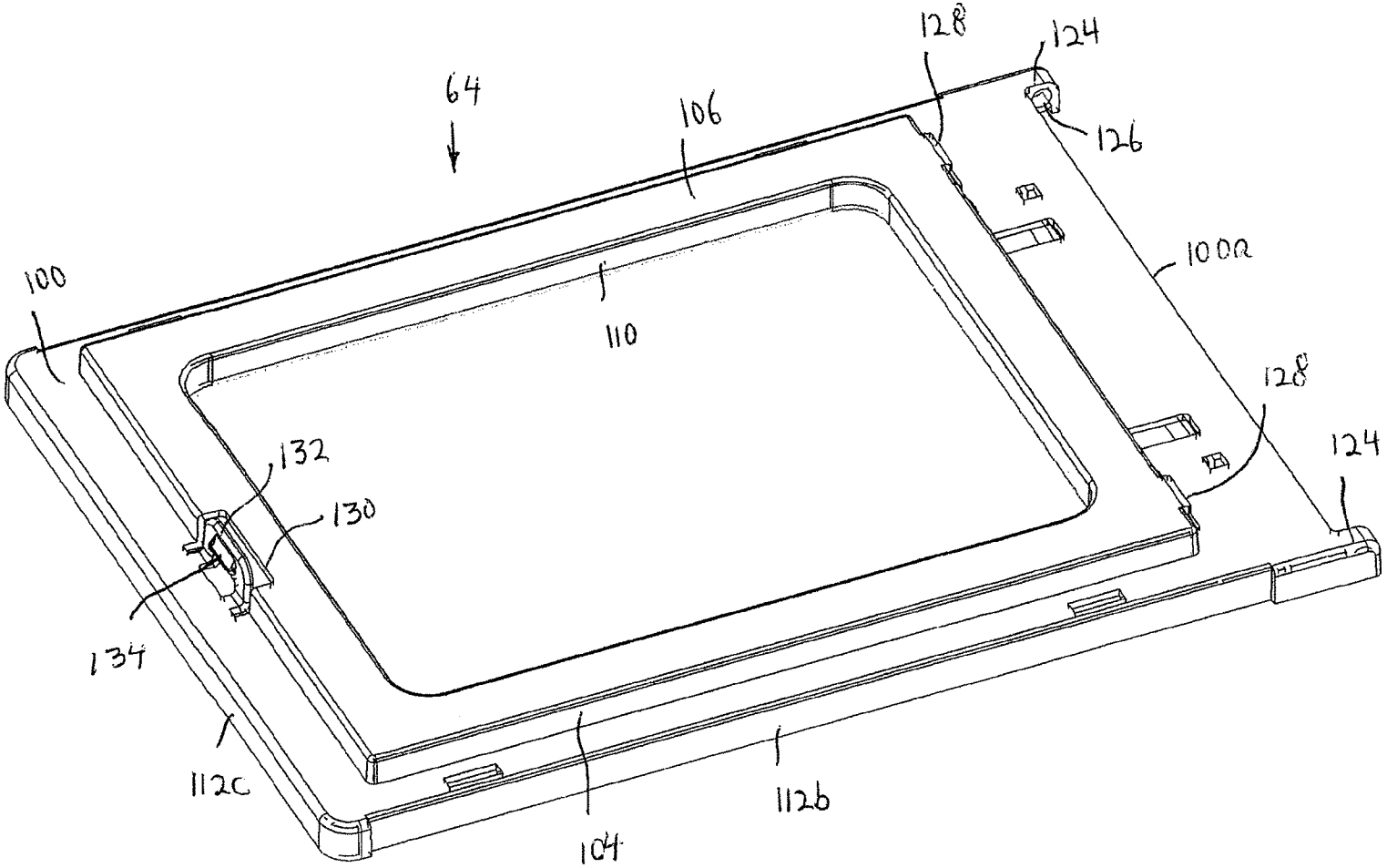
FIG. 15 is a rear, bottom perspective view of the bottom panel of the modular housing unit.

Bottom panel 64 connects together the lower ends of side panels 60 and 62. Specifically, as shown in FIGS. 13-15, bottom panel 64 includes an outer rectangular bottom wall 100 having a central rectangular opening 102. A downwardly extending inner peripheral wall 104 extends downwardly from the inner periphery of outer rectangular bottom wall 100 at rectangular opening 102 thereof. An inner rectangular bottom wall 106 connects the lower edges of downwardly extending inner peripheral wall 104, extends inwardly therefrom in parallel relation to outer rectangular bottom wall 100, and has a central rectangular opening 108. An upstanding wall 110 extends upwardly from the inner periphery of inner rectangular bottom wall 106 at central rectangular opening 108 thereof.

Bottom panel 64 further includes an outer peripheral wall 112 which extends upwardly from the outer periphery of outer rectangular bottom wall 100 and includes side wall portions 112*a* and 112*b* at the sides of outer rectangular bottom wall 100 and a rear wall portion 112*c* at the rear of outer rectangular bottom wall 100. Two transverse walls 114 and 116 extend upwardly from outer rectangular bottom wall 100 in parallel, spaced apart relation between the front edge 100*a* of rectangular bottom wall 100 and the inner periphery thereof, with each connected at its ends to side wall portions 112*a* and 112*b*.

In addition, two additional side walls 118*a* and 118*b* extend upwardly from rectangular bottom wall 100 in parallel, spaced relation to side wall portions 112*a* and 112*b*, respectively, so as to define narrow channels 120*a* and 120*b* therebetween. Each additional side wall 118*a* and 118*b* includes two spaced apart openings 122 therein.

In this manner, lower retaining walls 76 of side panels 60 and 62 fit within channels 120*a* and 120*b*, with triangular-shaped retaining walls 78 snap fitting into openings 122 in order to secure side panels 60 and 62 to bottom panel 64.

In addition, side wall portions 112*a* and 112*b* extend forwardly of the front edge of rectangular bottom wall 100, each including an inwardly facing ear 124 thereat with an inwardly facing opening 126, the purpose for which will be apparent from the discussion hereafter.

Figure 16:
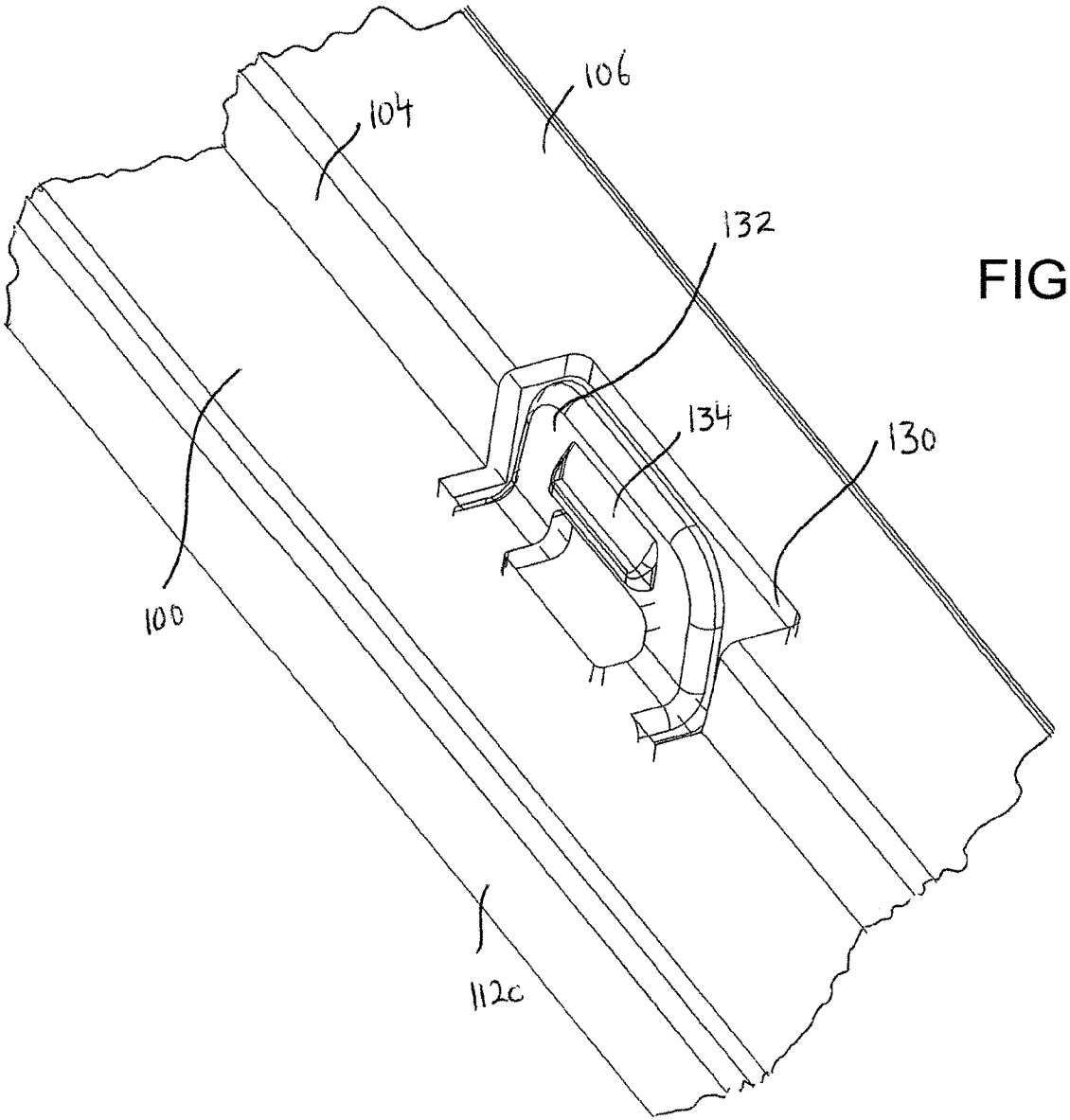
FIG. 16 is an enlarged rear, bottom perspective view of a portion of the bottom panel of the modular housing unit.

Further, bottom panel 64 includes two spaced apart tabs 128 extending forwardly of inner rectangular bottom wall 106. In addition, as best shown in FIG. 16, an L-shaped opening 130 is provided centrally in outer rectangular bottom wall 100 and downwardly extending inner peripheral wall 104, and as shown best in FIGS. 15 and 16, an L-shaped wall 132 is connected in a cantilevered manner to outer rectangular bottom wall 100 and extends within L-shaped opening 130. A generally triangular shaped tab 134 is provided on the outer surface of L-shaped wall 132.

With this arrangement, bottom panel 64 can be easily secured to base 16. Specifically, downwardly extending inner peripheral wall 104 fits within large rectangular recess 28. In this case, tabs 128 fit within L-shaped cutaways 54 and 56 of base 16, and L-shaped wall 132 fits within L-shaped cutaway 52 of base 16, with generally triangular shaped tab 134 releasably locking bottom panel 64 to base 16.

Figure 17:
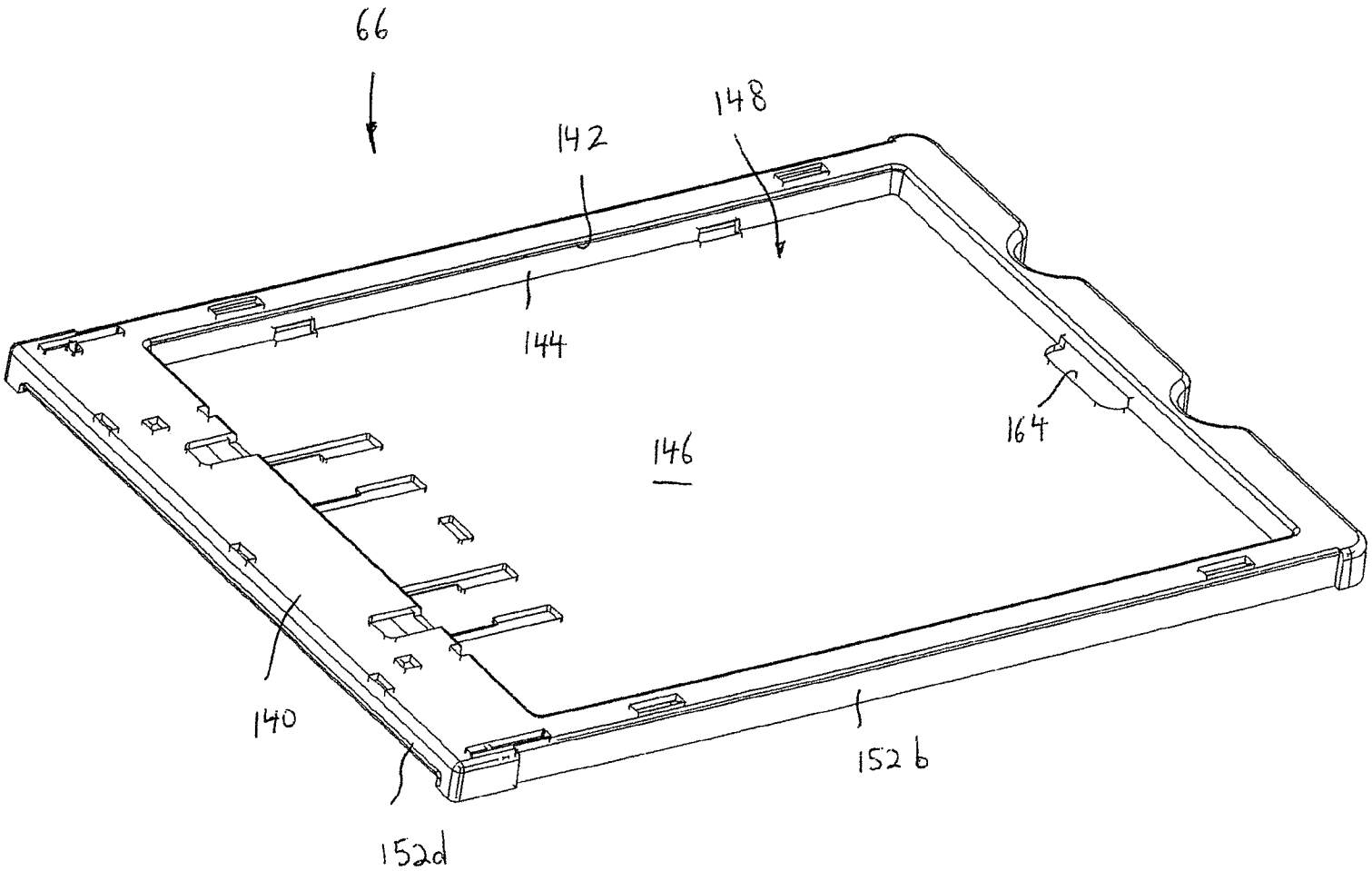
FIG. 17 is a front, top perspective view of the top panel of the modular housing unit.
Figure 18:
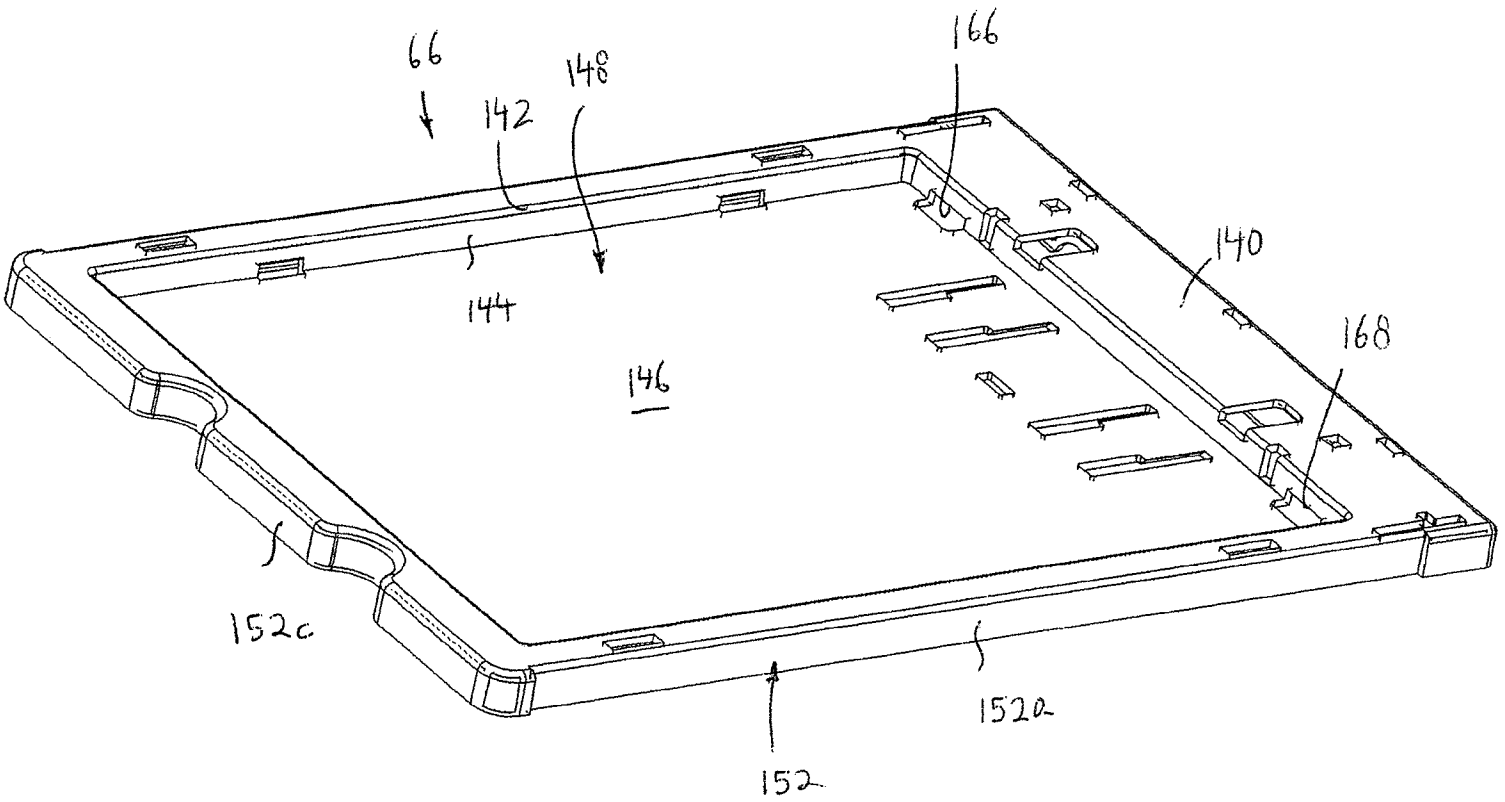
FIG. 18 is a rear, top perspective view of the top panel of the modular housing unit.
Figure 19:
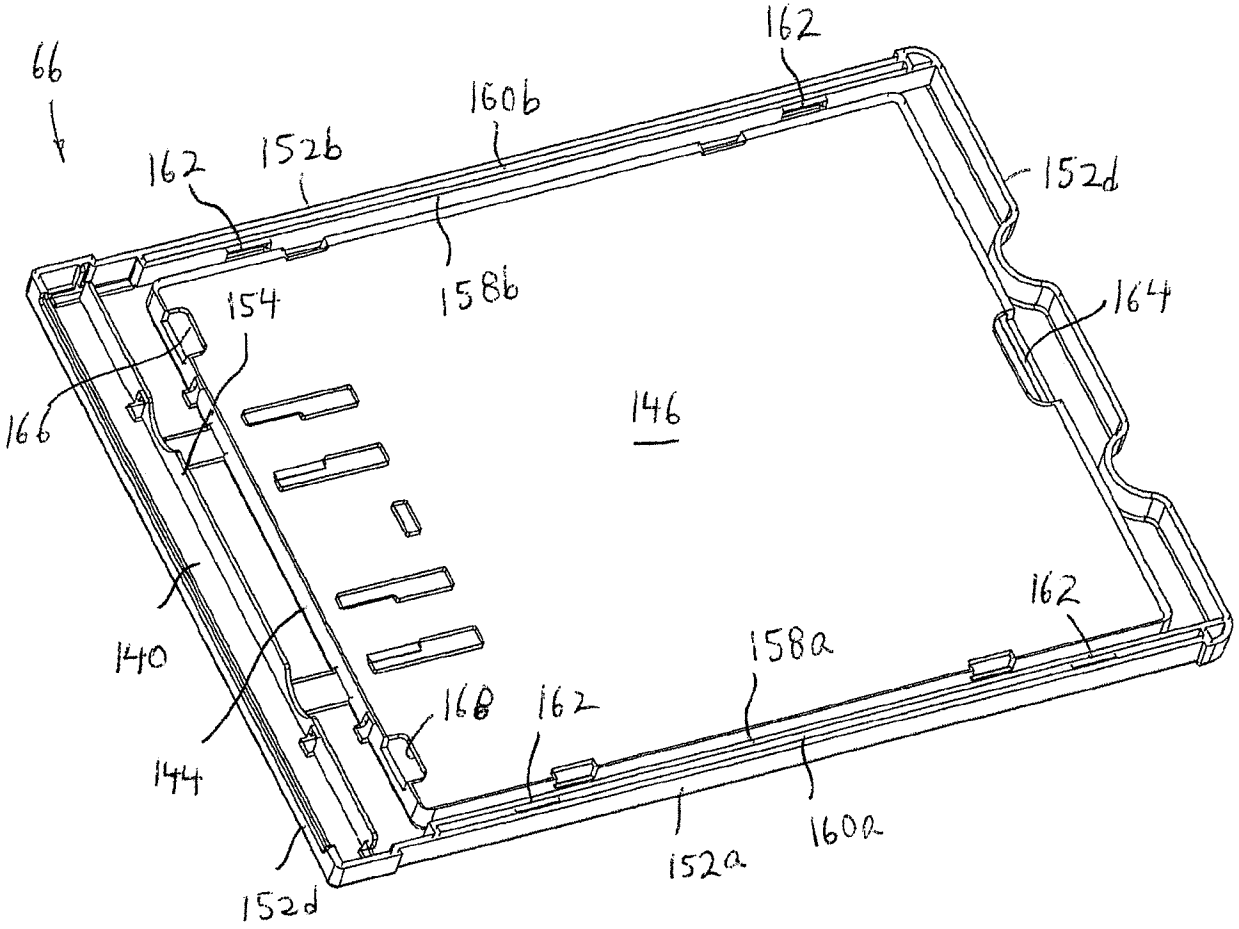
FIG. 19 is a front, bottom perspective view of the top panel of the modular housing unit.

Top panel 66 connects together the upper ends of side panels 60 and 62. Specifically, as shown in FIGS. 17-19, top panel 66 includes an outer rectangular top wall 140 having a central rectangular opening 142. A downwardly extending inner peripheral wall 144 extends downwardly from the inner periphery of outer rectangular top wall 140 at rectangular opening 142 thereof. An inner rectangular bottom wall 146 connects the lower edges of downwardly extending inner peripheral wall 144 and extends inwardly therefrom in parallel relation to outer rectangular top wall 140. As a result, a large rectangular recess 148 is defined by inner rectangular bottom wall 146 and downwardly extending inner peripheral wall 144. Rectangular recess 148, as will be discussed thereafter, is adapted to receive a housing 13 of another display and dispensing module 12 therein.

Top panel 66 further includes an outer peripheral wall 152 which extends downwardly from the outer periphery of outer rectangular top wall 140 and includes side wall portions 152*a* and 152*b* at the sides of outer rectangular top wall 140, a rear wall portion 152*c* at the rear of outer rectangular top wall 140, and a front wall portion 152*d* at the front of outer rectangular top wall 140. A transverse wall 154 extends downwardly from outer rectangular top wall 140 between downwardly extending inner peripheral wall 144 and front wall portion 152*d*, and is connected at its ends to side wall portions 152*a* and 152*b*.

In addition, two additional side walls 158*a* and 158*b* extend downwardly from rectangular top wall 140 in parallel, spaced relation to side wall portions 152*a* and 152*b*, respectively, so as to define narrow channels 160*a* and 160*b* therebetween. Each additional side wall 158*a* and 158*b* includes two spaced apart openings 162 therein.

In this manner, upper retaining walls 80 of side panels 60 and 62 fit within channels 160*a* and 160*b*, with triangular-shaped retaining walls 82 snap fitting into openings 162 in order to secure side panels 60 and 62 to top panel 66.

In the same manner at discussed above with respect to base 16, a first L-shaped cutaway 164 is formed centrally of bottom wall 146 and downwardly extending side wall 144 at the rear of top panel 66, and second and third L-shaped cutaways 166 and 168 are formed in spaced apart relation of bottom wall 146 and downwardly extending side wall 144 at the front of top panel 66. As will be appreciated from the discussion hereafter, cutaways 164, 166 and 168 are provided for securing the lower end of a housing 13 of another display and dispensing module 12 within large rectangular recess 148, in the same manner as discussed above with respect to base 16. As a result, a plurality of display and dispensing modules 12 can be connected with each other and arranged in column 14 upon base 16, as shown in FIG. 1.

Figure 20:
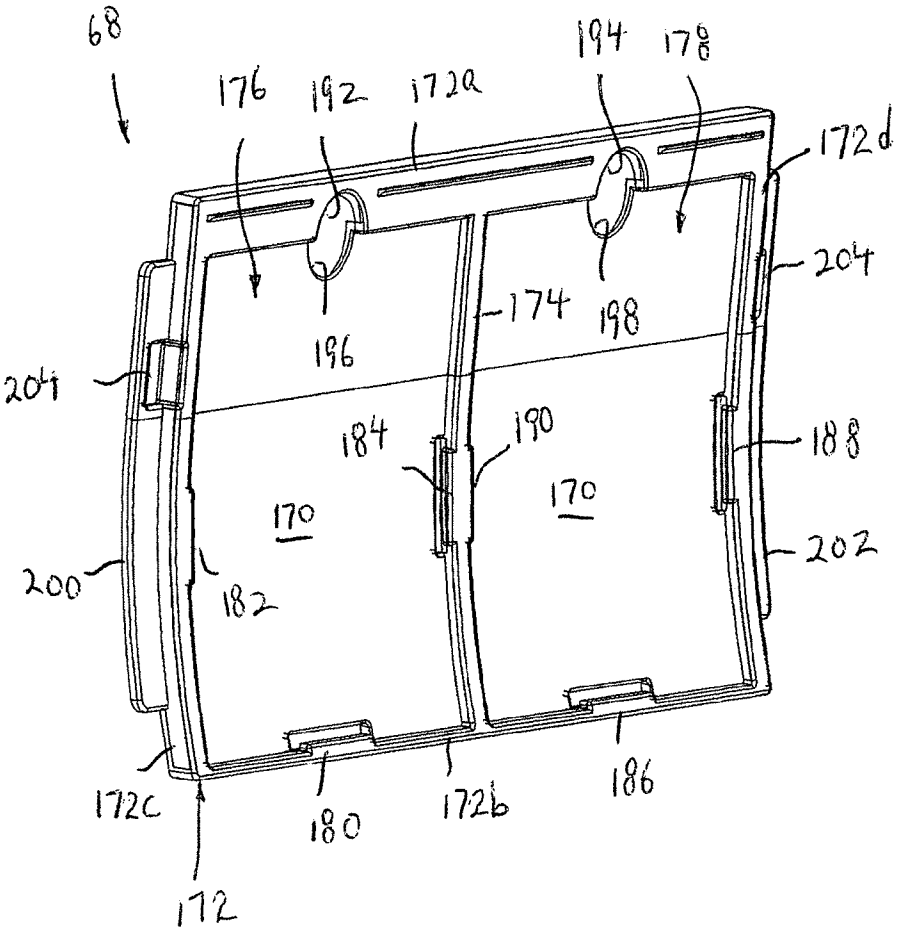
FIG. 20 is a front perspective view of the ticket frame holder of the modular housing unit.

Referring now to FIG. 20, ticket frame holder 68 includes a rectangular, slightly arcuate wall 170 closed around his periphery by a peripheral wall 172 having a top wall portion 172*a*, a bottom wall portion 172*b* and opposite side wall portions 172*c* and 172*d*, and bisected by a vertical divider wall 174 at its front surface. As a result, a first shallow recess 176 is defined by slightly arcuate wall 170 and surrounding wall portions 172*a*, 172*c*, 172*b* and divider wall 174, and a second shallow recess 178 is defined by slightly arcuate wall 170 and surrounding wall portions 172*a*, 172*d*, 172*b* and divider wall 174, with each shallow recess 176 and 178 adapted to hold a display card 175 of a lottery ticket therein.

Specifically, the inner surfaces of wall portions 172*b*, 172*c* and divider wall 174 associated with recess 176 are provided with retaining tabs 180, 182 and 184, which are spaced slightly forwardly of arcuate wall 170 in order to provide a small gap therebetween in which the display card 175 of the lottery ticket can be removably held in place in recess 176. In like manner, the inner surfaces of wall portions 172*b*, 172*d* and divider wall 174 associated with recess 178 are provided with retaining tabs 186, 188 and 190, which are spaced slightly forwardly of arcuate wall 170 in order to provide a small gap therebetween in which the display card 175 of the lottery ticket can be removably held in place in recess 178. Wall portion 172*a*, at a position centrally of recess 176, is provided with a semicircular recess 192, and wall portion 172*a*, at a position centrally of recess 178, is provided with a semicircular recess 194. Complementary semicircular recesses 196 and 198 are provided in arcuate wall 170 immediately below semicircular recesses 192 and 194, respectively, to provide circular recesses. In this manner, a person can insert a finger into semicircular recesses 192 and 194 to remove a display card 175 of the lottery ticket.

A first side securing flange 200 extends outwardly from the outer surface of wall portion 172*c*, and a second side securing flange 202 extends outwardly from the outer surface of wall portion 172*d*. Side securing flanges 200 and 202 are adapted to be captured within vertically oriented, slightly arcuate openings 88 of side panels 60 and 62 in order to retain ticket frame holder 68 thereat. Further, each side securing flange 200 and 202 includes an opening 204 at the upper end thereof, the purpose for which will become apparent from the discussion hereafter.

Figure 21:
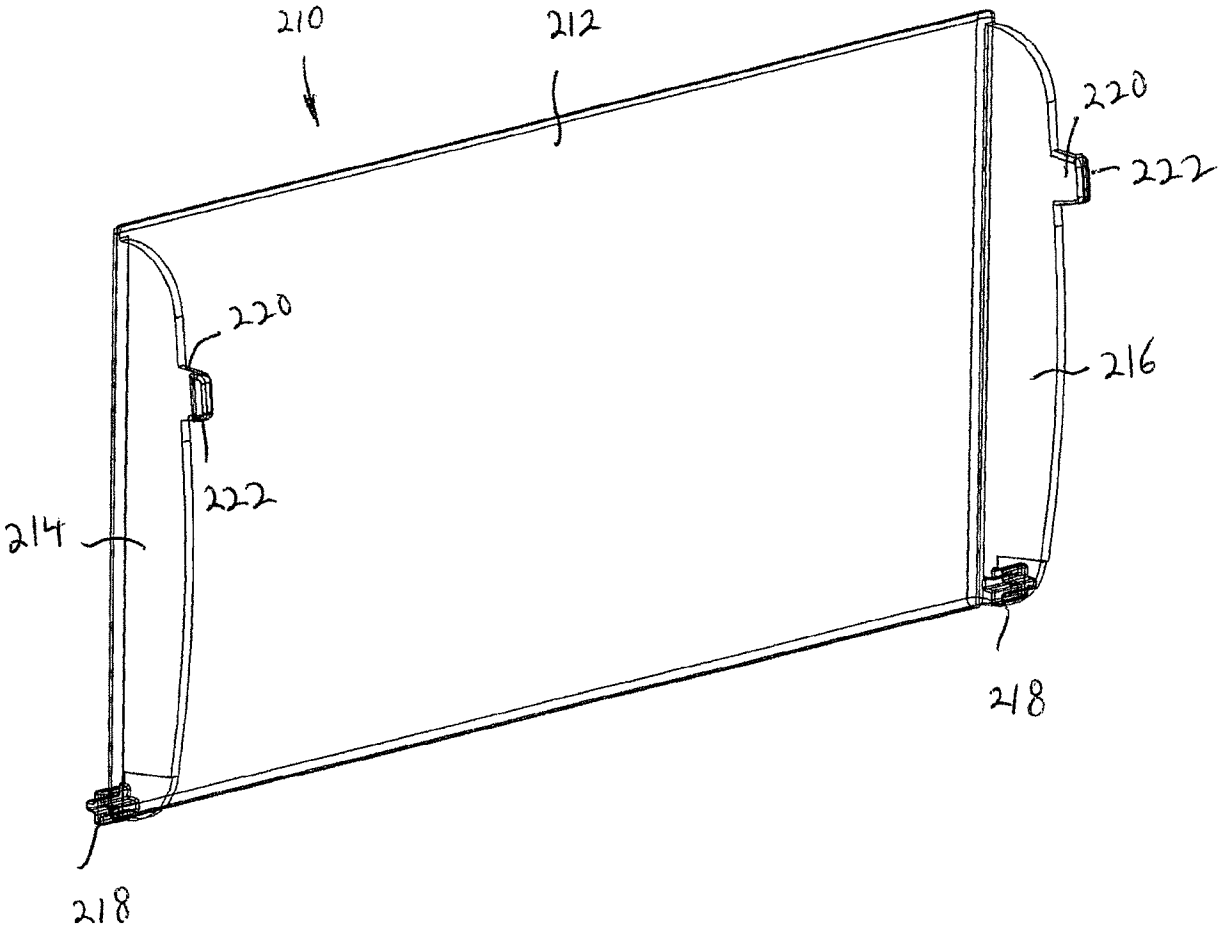
FIG. 21 is a rear perspective view of the transparent lens cover of the modular housing unit.
Figure 22:
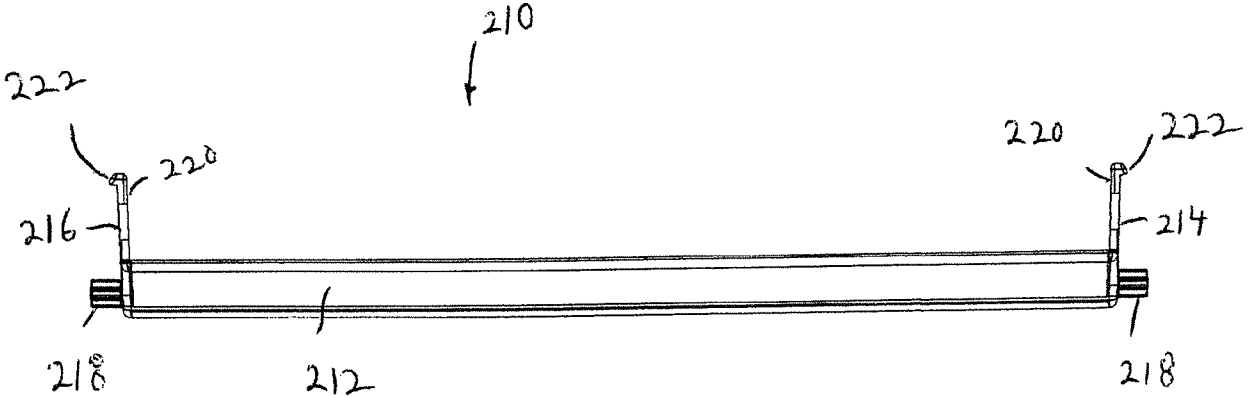
FIG. 22 is a top plan view of the transparent lens cover.

As shown best in FIGS. 21 and 22, a transparent lens cover 210 is provided in covering relation to the display card 175 of the lottery ticket held by ticket frame holder 68. Specifically, lens cover 210 includes a rectangular transparent wall 212 with two transparent side walls 214 and 216 extending rearwardly from opposite sides thereof. A pivot 218 extends outwardly from the outer surfaces of each side wall 214 and 216 at the lower ends thereof. A narrow flange 220 extends rearwardly from the upper ends of the rear surfaces of side walls 214 and 216, with each flange 220 having an outwardly extending retaining tab 222 at the rearmost edge thereof.

With this arrangement, pivots 218 are pivotally held within openings 126 of inwardly facing ears 124 of bottom panel 64, for movement between a pivoted down, open position for inserting and removing the display card 175 of the lottery tickets, and a closed position in covering relation to the lottery tickets, as shown in FIG. 1. In the closed position, narrow flanges 220 extend through openings 204 of ticket frame holder 68, and retaining tabs 222 engage behind slightly arcuate retaining walls 89 of side panels 60 and 62.

To replace a display card 175 of the lottery ticket, it is only necessary to squeeze in side walls 214 and 216 in order to release retaining tabs 222 from behind slightly arcuate retaining walls 89 of side panels 60 and 62, whereby transparent lens cover 210 can be pivoted to its open position.

Figure 23:
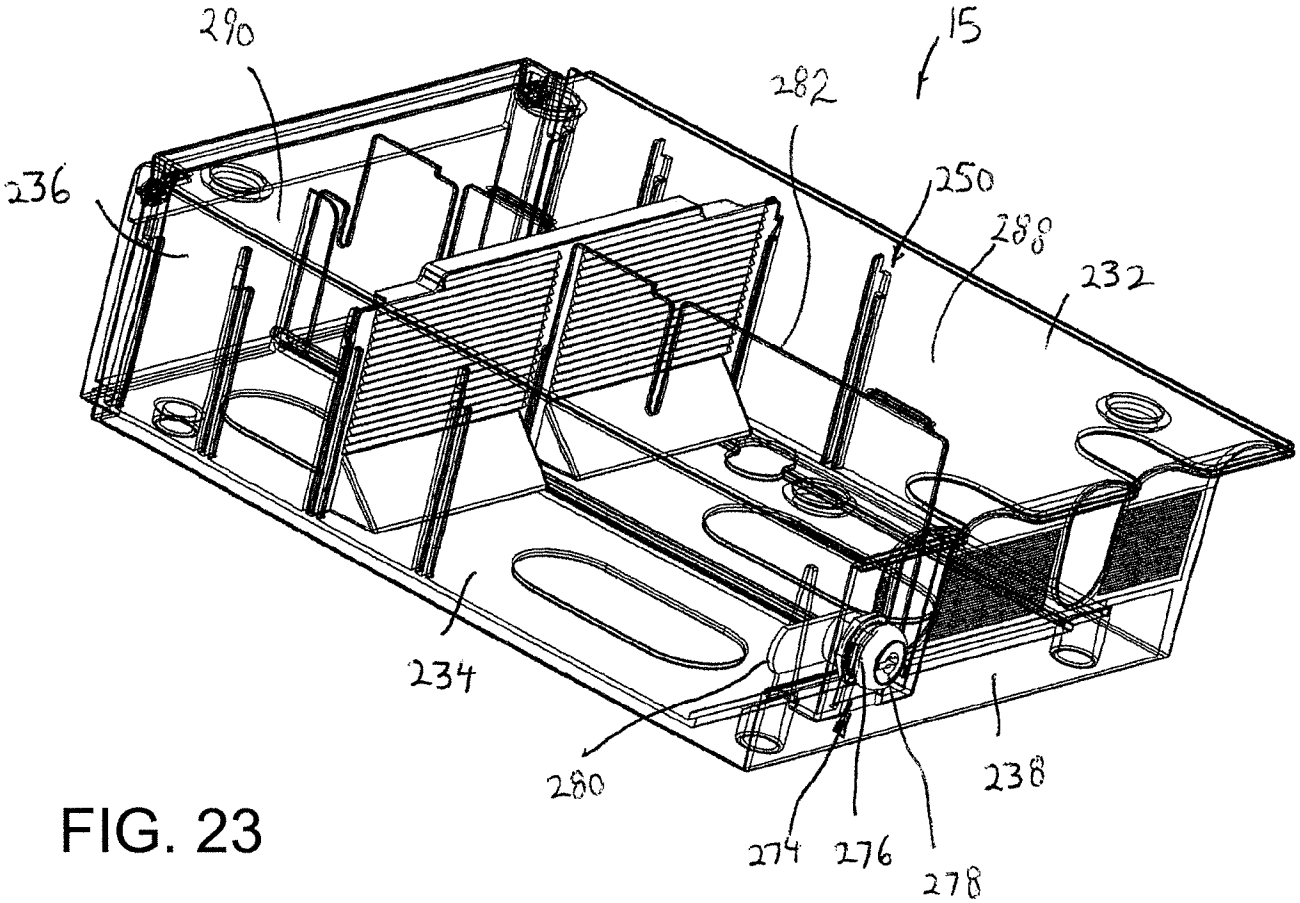
FIG. 23 is a rear, top perspective view of one drawer for insertion into a modular housing unit, with the dividers therein.
Figure 24:
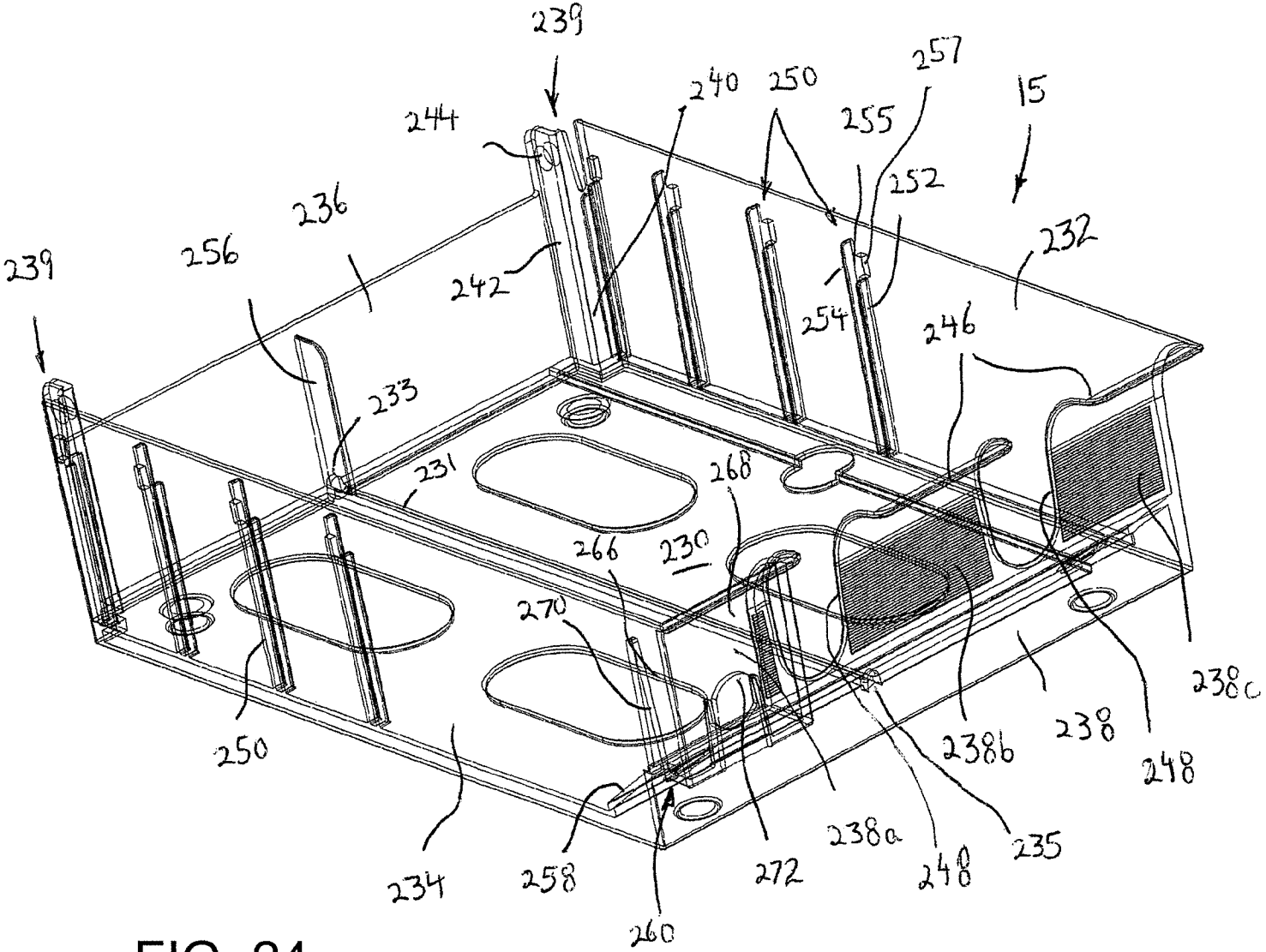
FIG. 24 is a rear, top perspective view of the drawer, with the dividers removed.
Figure 25:
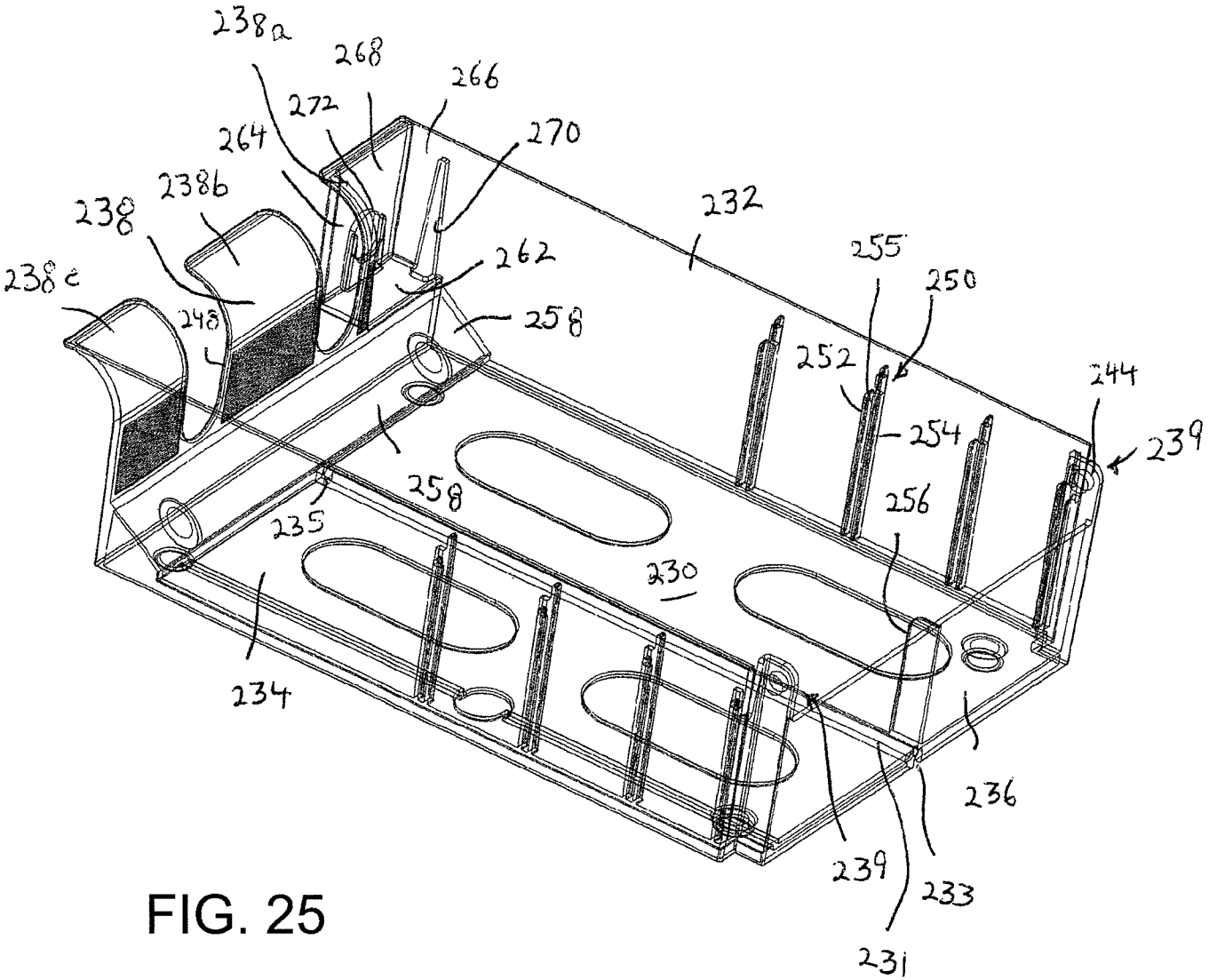
FIG. 25 is a front, top perspective view of the drawer, with the dividers removed.

Referring now to FIGS. 23-25, the drawer 15 of each display and dispensing module 12 includes a rectangular bottom wall 230, two upstanding side walls 232 and 234 on opposite sides of bottom wall 230, a front wall 236 connecting together side walls 232 and 234 at front ends thereof, and a rear wall 238 connecting together side walls 232 and 234 at rear ends thereof. Preferably, drawer 15 is made of a transparent plastic material.

Bottom wall 230 has dimensions to slidably fit within the open rear end of housing 13 of each display and dispensing module 12. Specifically, bottom wall 230 is dimensioned to slidably ride over and be supported by lower tray guiding ledge 72 of side panels 60 and 62, while the upper edges of side walls 232 and 234 are guided under upper tray guiding ledge 74 of side panels 60 and 62.

Each side wall 232 and 234 includes an L-shaped extension 239 at the front thereof, which is formed by a narrow, inwardly extending vertical wall 240 and a narrow, forwardly extending vertical wall 242 connected to the free end of vertical wall 240. Front wall 236 is connected at its opposite ends to the free ends of forwardly extending vertical wall 242. It will be appreciated that the height of front wall 236 is less than the height of side walls 232 and 234. In addition, the upper end of each forwardly extending vertical wall 242, at a position above the upper edge of front wall 236, has an opening 244 therein, the purpose for which will become apparent hereafter.

Rear wall 238 is connected at its opposite ends to the rear edges of side walls 232 and 234. As shown, the upper portion 246 of rear wall 238 curves upwardly and rearwardly, which provides a pullout surface for removing lottery tickets for sale, which are connected end to end, with a perforation line between connected lottery tickets. In addition, rear wall 238 includes two spaced apart cutaway recesses 248, which separate upper portion 246 into three distinct and separated rear wall parts 238*a*, 238*b* and 238*c*.

Side walls 232 and 234 further include spaced apart vertical guides 250 at the inner surfaces thereof, which are in alignment with each other. Each guide 250 is formed by two parallel, spaced apart, vertically extending walls 252 and 254, with one wall 252 being shorter than the other wall 254. As a result, a vertically oriented slot 255 is formed between each set of vertically extending walls 252 and 254. Further, the inner surface of side walls 232 and 234 immediately above vertically oriented slots 255 are provided with a deeper recess 257.

Bottom wall 230 further includes a lengthwise recess 231 extending from the front edge to the rear edge thereof, and centrally of bottom wall 230. The front of recess 231 terminates in and communicates with an aligned opening 233 at the lower end of front wall 236 and the rear of recess 231 terminates in and communicates with an aligned opening 235 at the lower end of rear wall 238.

Front wall 236 includes a restraining wall 256 extending inwardly from the inner surface thereof, immediately to one side of recess 231.

A ramp 258 extends from a rear portion of bottom wall 232 upwardly and rearwardly to a position on rear wall 238 immediately below cutaway recesses 248, for aiding in the removal of lottery tickets from tray 15.

In addition, a lock housing 260 is formed rearwardly of rear wall part 238*a*. Lock housing 260 includes a bottom wall 262 extending rearwardly from rear wall part 238*a*, generally in alignment with the lower end of recesses 248, opposite side walls 264 and 266 connected to opposite sides of bottom wall 262 at the lower ends and to curved rear wall 238 at their forward ends, and a rear wall 268 which connects together the rearmost edges of bottom wall 262 and side walls 264 and 266. Because of the curvature of rear wall 238, rear wall 238 serves as the top closure wall of lock housing 260. In addition, side wall 266 includes a vertically oriented, inverted V-shaped opening 270 therein.

Figure 31:
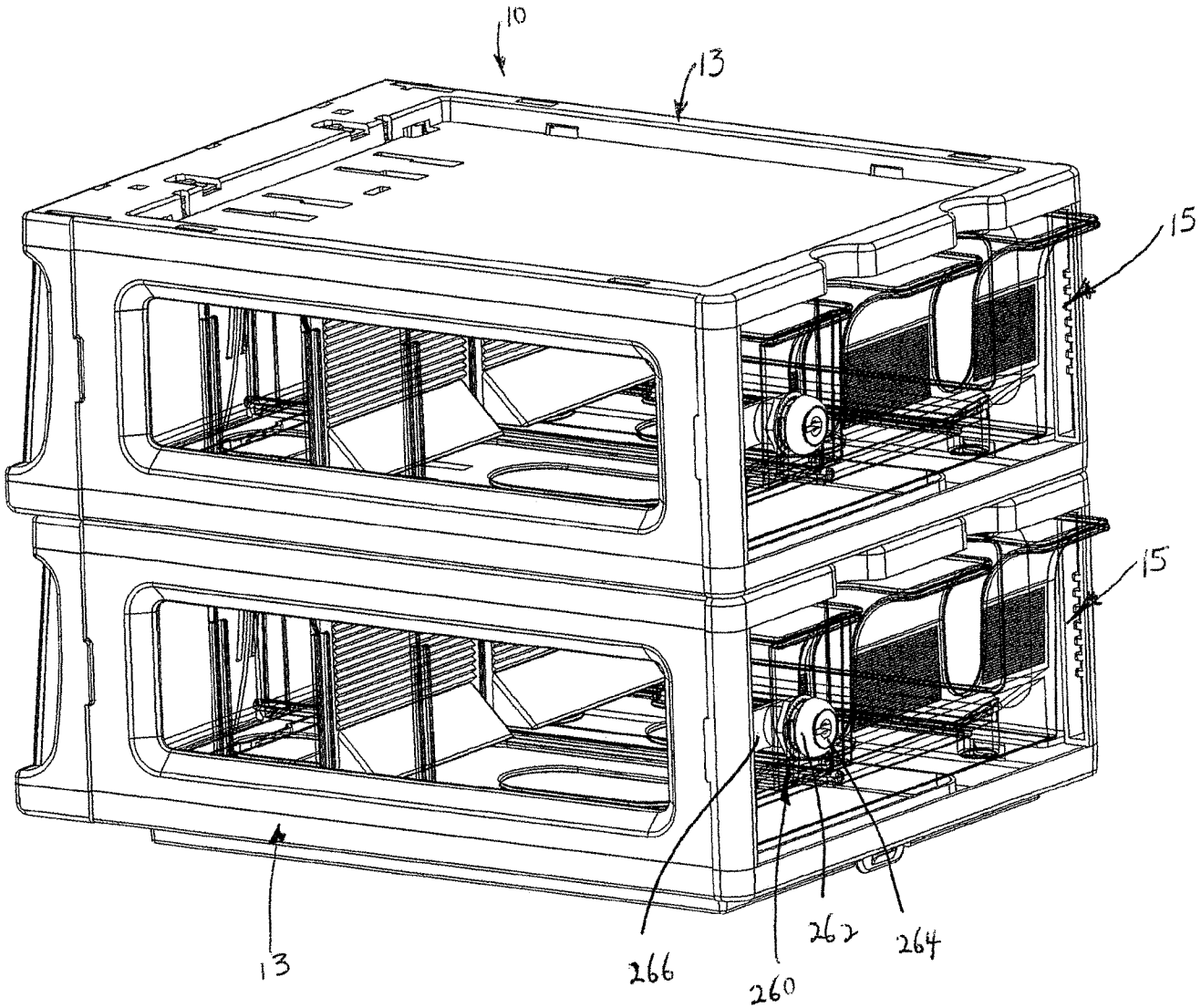
FIG. 31 is a rear perspective view of two display and dispensing modules connected together, with the drawers therein.

Rear wall 268 includes an opening 272 for receiving a key lock 274 therethrough, as best shown in FIGS. 23 and 31, with key lock 274 being housed within lock housing 260. Key lock 274 includes a conventional tumbler lock 276 which is controlled by a key inserted into a key opening 278 therein. Key lock 274 further includes a rotatable retainer plate 280 at the forward end thereof which is rotated between a vertically upright position and a horizontal position (shown in FIGS. 23 and 31). When drawer 15 is fully slid into housing 11, retainer plate 280 is in its vertical upright position, and when the key is rotated in key opening 278 to a locked position, retainer plate 280 is rotated to its horizontal position shown in FIGS. 23 and 31, whereby the end of retainer plate 280 extends through inverted V-shaped opening 270 and enters vertically oriented slot 92 of side panel 60 to lock drawer 15 in housing 11, thereby keeping the lottery tickets safe from theft.

In accordance with the present invention, drawer 15 is adapted to accommodate different size lottery tickets.

Figure 26:
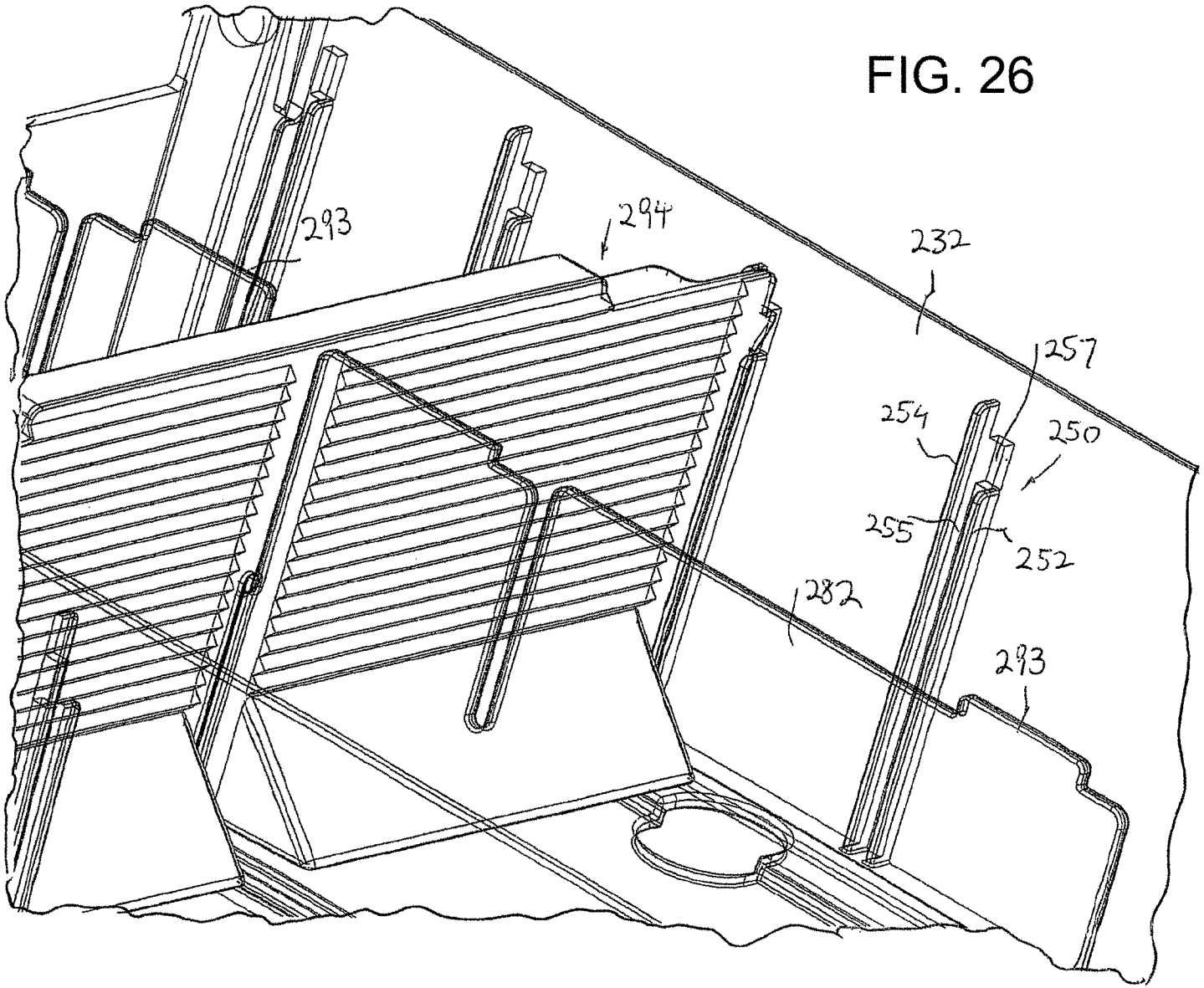
FIG. 26 is an enlarged rear, top perspective view of a portion of the drawer of FIG. 23.
Figure 27:
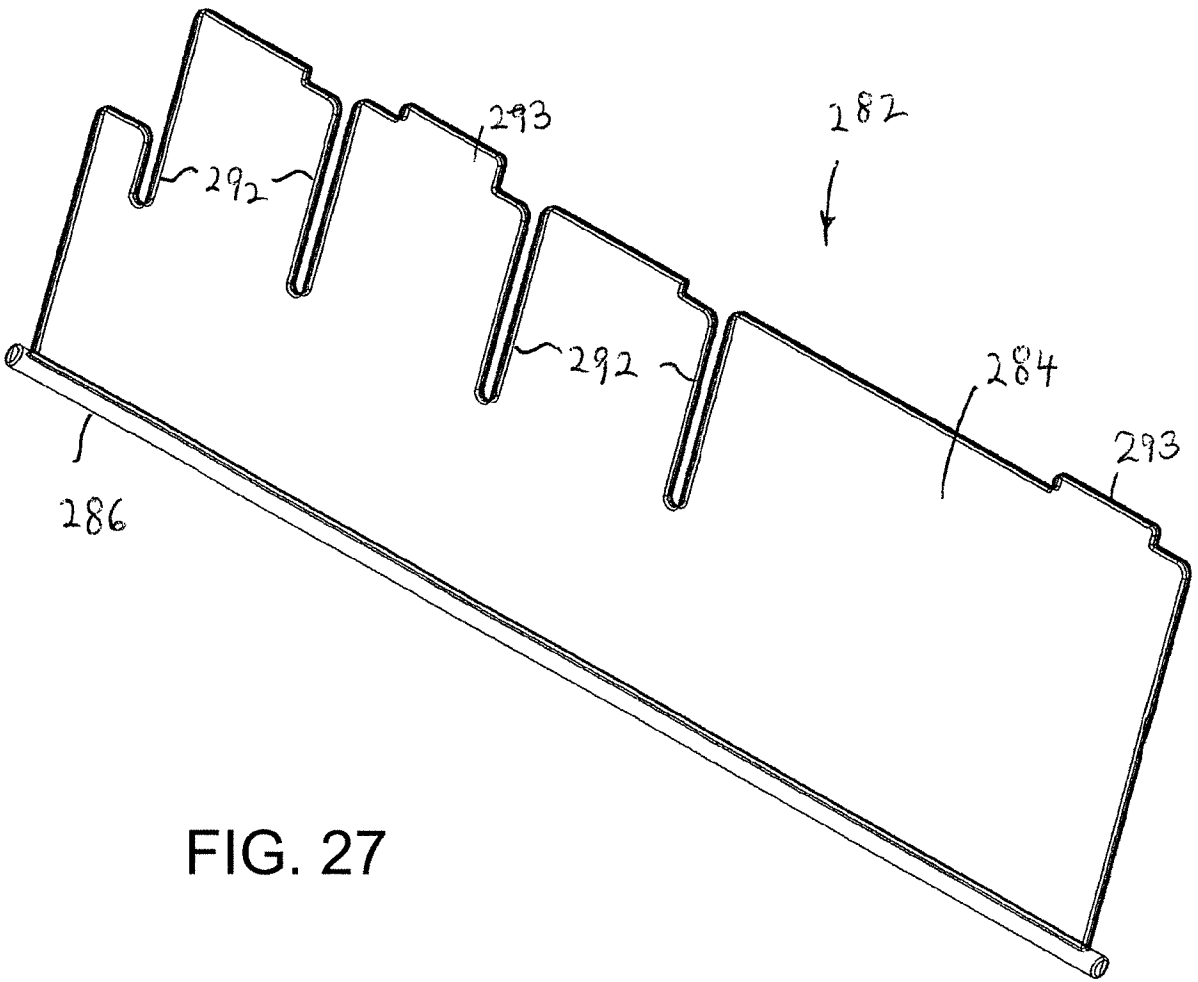
FIG. 27 is a perspective view of the lengthwise, center divider.
Figure 28:
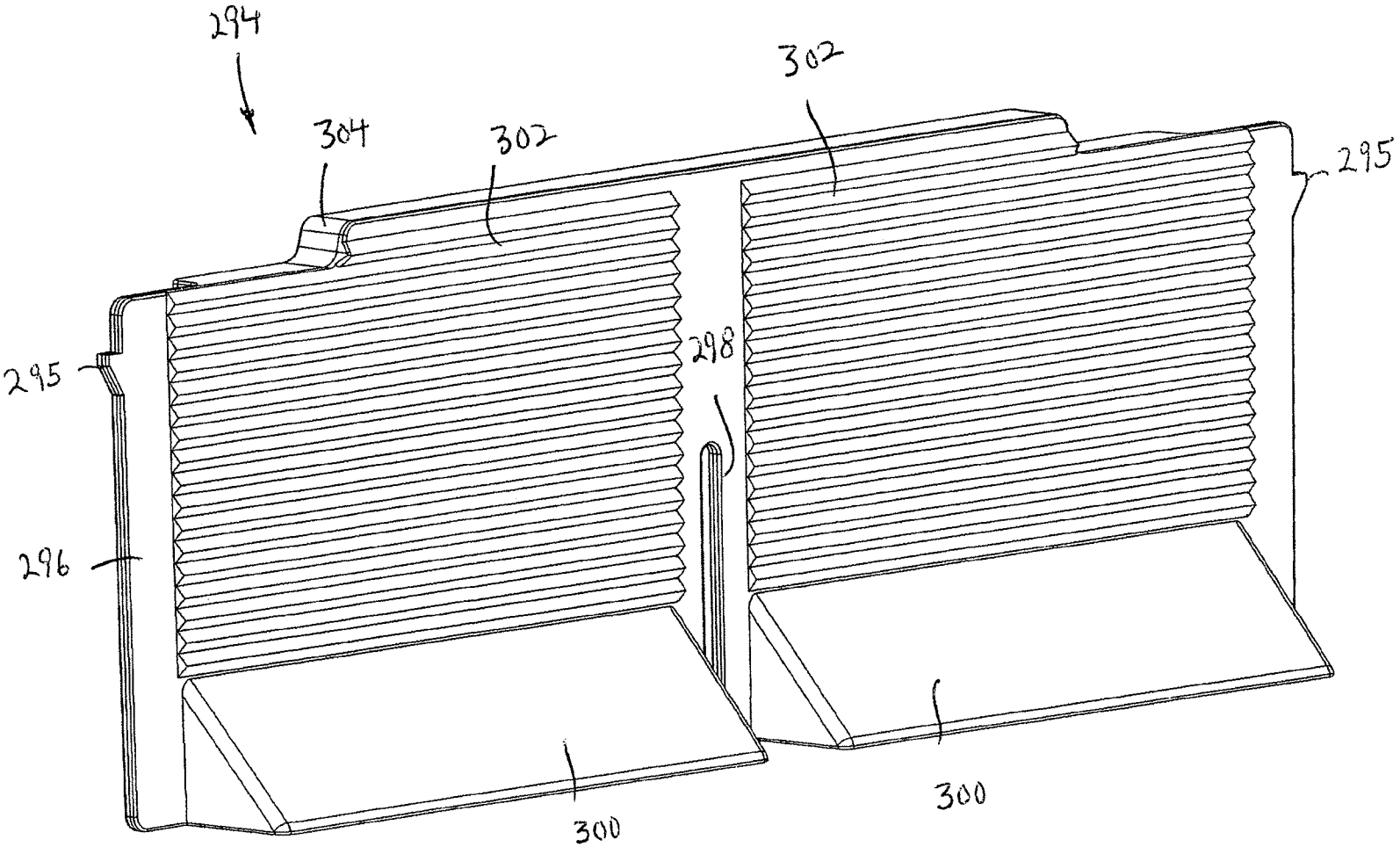
FIG. 28 is a rear perspective view of the short transverse divider.
Figure 29:
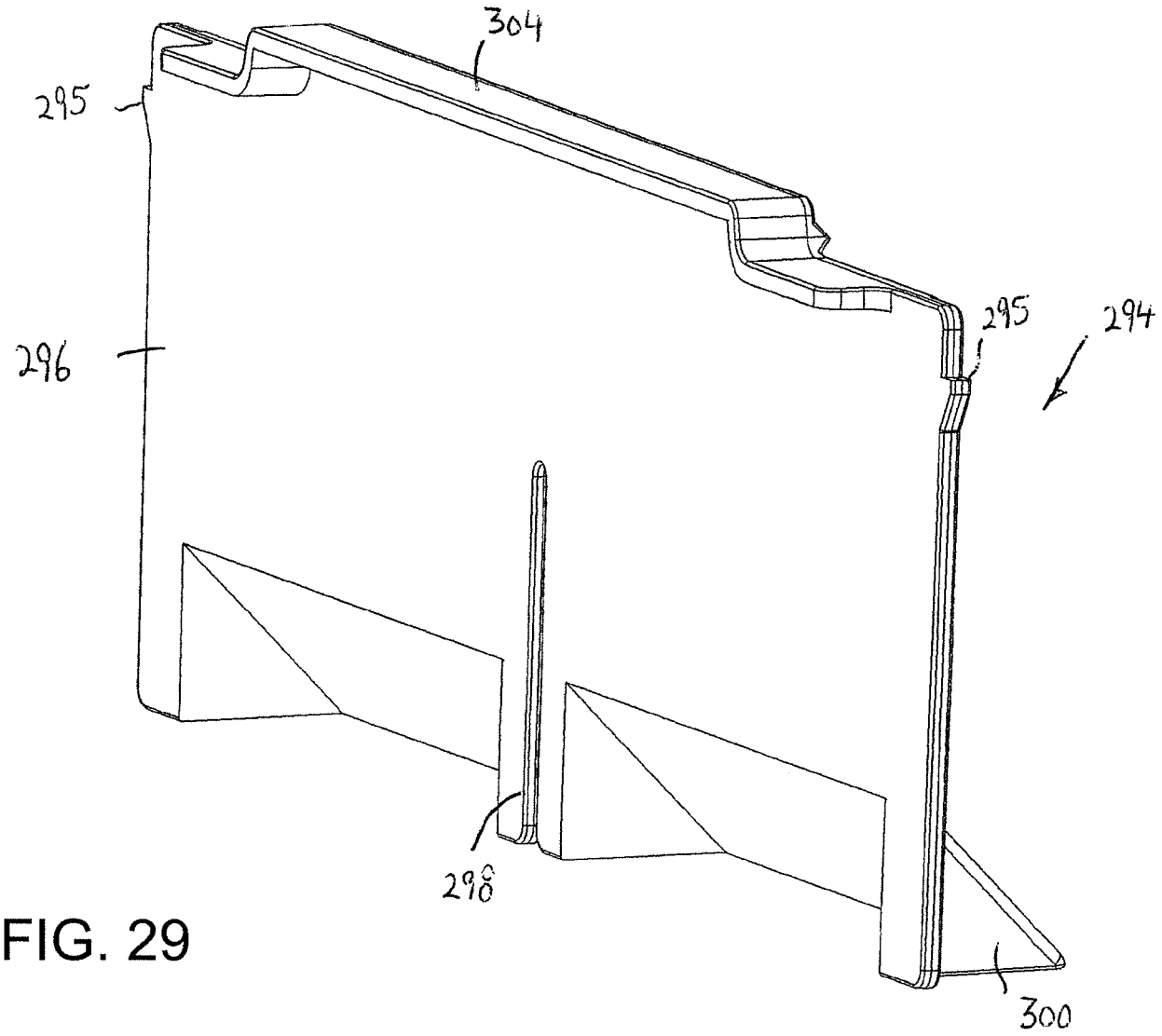
FIG. 29 is a front perspective view of the short transverse divider.
Figure 30:
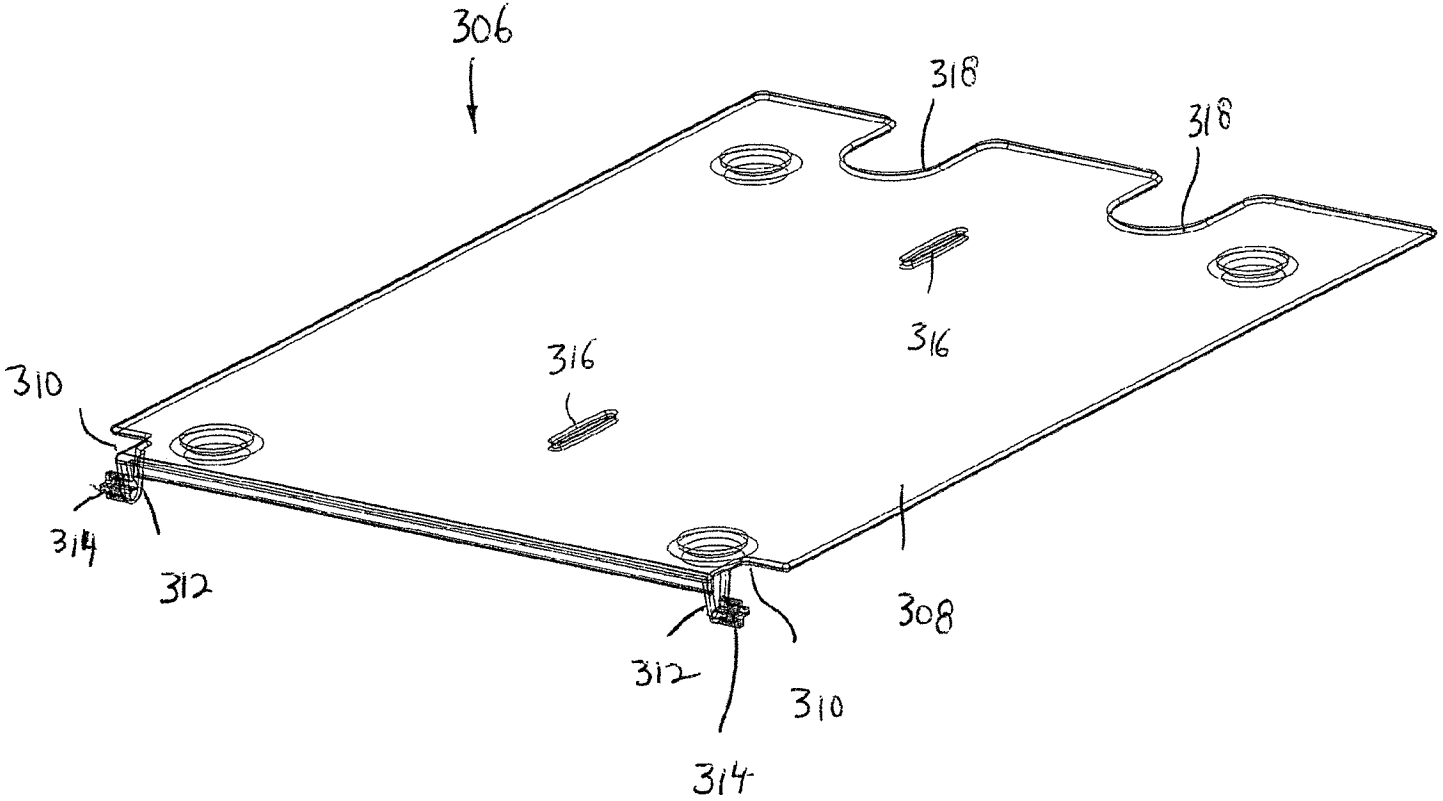
FIG. 30 is a perspective view of the drawer lid.

Specifically, as shown best in FIGS. 23, 26 and 27, a lengthwise center divider 282 includes an elongated, generally rectangular plate 284 which extends in a lengthwise direction and bisects drawer 15 for accommodating different widthwise dimensioned lottery tickets. A circular rod 286 of a greater length than rectangular plate 284, is connected to the lower edge of rectangular plate 284. In this manner, rod 286 is rotatably positioned within lengthwise recess 231 of drawer 15, with the ends of rod 286 captured in openings 233 and 235 of drawer 15. This permits lengthwise center divider 282 to pivoted between the upright position shown in FIG. 23 which separates drawer 15 into two compartments 288 and 290 on opposite sides of lengthwise center divider 282 for holding two stacks of lottery tickets, and a position where lengthwise center divider 282 lies flat on bottom wall 230 of drawer 15, thereby providing one large compartment for holding one stack of larger width lottery tickets. Restraining wall 256 functions to limit the upright pivoting movement of lengthwise center divider 282 in its upright position.

In addition, lengthwise center divider 282 includes a plurality of spaced apart, vertically oriented slots 292, extending downwardly from the upper surface thereof.

Finally, lengthwise center divider 282 includes two spaced apart tabs 293 at the upper edge thereof.

As shown best in FIGS. 23, 26, 28 and 29, a short transverse divider 294 is provided for accommodating different lengthwise dimensioned lottery tickets.

Short transverse divider 294 includes a generally rectangular divider wall 296, the ends of which are adapted to fit within vertically oriented slots 255 of aligned vertical guides 250 of upstanding side walls 232 and 234 of drawer 15. Short transverse divider 294 can be used with or without lengthwise center divider 282. To use in conjunction with lengthwise center divider 282, short transverse divider 294 includes a central slot 298, opening at the lower end thereof, with central slot 298 adapted to engage with any of vertically oriented slots 292 of lengthwise center divider 282, as shown, for example, in FIG. 23.

Thus, the combination of lengthwise center divider 282 and short transverse divider 294 function to accommodate different widthwise and lengthwise size lottery tickets.

To aid in the withdrawal of the lottery tickets, short transverse divider 294 includes a lower ramp 300 at the rearward side of rectangular divider wall 296 on opposite sides of central slot 298. Further, to easily separate the lottery tickets, which are connected end to end with each other, the rearward surface of rectangular divider wall 296 at a position above lower ramp 300 includes serrations 302 for engaging the ends of the lottery tickets.

The upper end of rectangular divider wall 296 is provided with a forwardly extending gripping wall 304 by which short transverse divider 294 can be gripped for removal from for insertion into drawer 15.

In addition, short transverse divider 294 includes a tab 295 extending outwardly from the upper end of each side edge of rectangular divider wall 296. When the sides of rectangular divider wall 296, are fit within vertically oriented slots 255 of aligned vertical guides 250 of upstanding side walls 232 and 234 of drawer 15, because of the resilient nature of the plastic material, tabs 295 snap fit into deeper recesses 257 of drawer 15 to releasably lock short transverse divider 294 in position. It will be appreciated that the end to end width of short transverse divider 294 at tabs 295 does not permit movement of tabs 295 into vertically oriented slots 255.

It will be appreciated that more than one transverse divider 294 can be provided, with each divider 294 connected at a different position with respect to lengthwise center divider 282.

Lastly, drawer 15 includes a pivoting cover 306 pivotally mounted to the upper end of drawer 15. Specifically, cover 306 includes a rectangular cover plate 308, with corner cutouts 310 at opposite front corners thereof. A pivot support 312 extends downwardly from cover plate 308 at corner cutouts 310, with a pivot 314 extending outwardly from the lower ends of each pivot support 312. Pivots 312 are pivotally held within openings 244 of L-shaped extensions 239 for movement between a closed position shown in FIG. 23 where rectangular cover plate 300 seats on the upper edges of upstanding side walls 232 and 234, and a raised, pivoted up position where lengthwise center divider 282 and short transverse divider 294 can be adjusted and where lottery tickets can be removed from or inserted into drawer 15.

Cover 306 includes two spaced apart, lengthwise extending slots 316 for receiving tabs 293 of lengthwise center divider 282 in the closed position.

With this arrangement, the lottery tickets, which are connected end to end, are adapted to be pulled out of drawer 15 from the rear thereof between curved upper portion 246 of rear wall 238 and cover plate 308.

Lastly, cover plate 308 includes arcuate recesses 318 at the rear edge thereof for alignment with cutaway recesses 248.

Thus, At the request of a purchaser, the sales clerk will withdraw a lottery ticket from the rear of a drawer 15, while the drawer 15 remains closed and locked within housing 11. The purchaser will make a selection based upon viewing a sample of the lottery ticket displayed behind transparent lens cover 210 at the front of a module 12 and corresponding to the lottery tickets within drawer 15. The supply of lottery tickets in a drawer 15 is replenished readily by unlocking and opening the drawer 15 for convenient restocking.

It will be appreciated that, although the present invention has been discussed with respect to lottery tickets, the present invention is not limited thereby and can be used with any items for sale.

Having described a specific preferred embodiment of the invention with reference to the accompanying drawings, it will be appreciated that the present invention is not limited to that precise embodiments and that various changes and modifications can be effected therein by one of ordinary skill in the art without departing from the scope or spirit of the invention as defined by the appended claims.

What is claimed is:

1. A modular display and dispensing assembly for the sale of items, the assembly comprising:

a base adapted to be securely mounted to a substrate at a prescribed display and dispensing location on the substrate; and at least one display and dispensing module for mounting on the base;

each display and dispensing module including:

a housing for mounting on the base; and a drawer for holding the items for sale, the drawer adapted to be removably positioned and secured in the housing for dispensing the items for sale while the drawer is secured in the housing;

each drawer including at least one adjustable divider for varying at least one compartment size in the drawer for holding different size items for sale;

wherein said at least one adjustable divider includes a first divider for providing that the drawer includes one of the following:

a single compartment, or two compartments separated by the first divider;

wherein the first divider is pivotally mounted in the drawer for movement between:

a first position in which the first divider is positioned upright and divides the single compartment into two separate compartments, and a second position in which the first divider is pivoted down over a bottom wall of the drawer to provide a single large compartment in the drawer.

2. A modular display and dispensing assembly according to claim 1, wherein the first divider extends in a lengthwise direction of the drawer.

3. A modular display and dispensing assembly according to claim 1, wherein said drawer includes a recess, and wherein said first divider includes a divider plate and a pivot rod connected to one end of the divider plate, with the pivot rod rotatably mounted in said recess for permitting pivotal movement of the first divider between the first position and the second position.

4. A modular display and dispensing assembly according to claim 1, wherein the drawer includes a restraining member for limiting pivotal movement of the first divider to said first position.

5. A modular display and dispensing assembly according to claim 1, wherein the at least one adjustable divider includes a second divider extending transversely of the first divider and engaging with the first divider when the first divider is in the first upright position.

6. A modular display and dispensing assembly according to claim 5, wherein the first divider includes a plurality of slots extending down from an upper surface thereof, and wherein the second divider includes at least one slot extending up from a lower surface thereof for engaging with one of the slots of the first divider to position the second divider in one of a plurality of positions along the first divider.

7. A modular display and dispensing assembly according to claim 5, wherein the first divider extends in a lengthwise direction of the drawer, and the second divider extends in a transverse direction of the drawer.

8. A modular display and dispensing assembly according to claim 5, wherein the second divider includes a plurality of serrations along a surface thereof for aiding in separation of the items to be dispensed from the drawer while the drawer is secured in the housing.

9. A modular display and dispensing assembly according to claim 5, wherein the second divider includes at least one ramp at a lower end thereof for aiding in the removal of the items from the drawer.

10. A modular display and dispensing assembly according to claim 5, wherein the drawer includes opposite side walls having a plurality of aligned, vertically extending slots for receiving side edges of the second divider therein.

11. A modular display and dispensing assembly according to claim 10, wherein each side edge of the second divider includes a retaining tab at an upper end thereof, and the drawer includes deeper recesses above the vertically extending slots for receiving the retaining tabs therein to releasably lock the second divider to the drawer at a desired position.

12. A modular display and dispensing assembly according to claim 1, wherein the items for sale are end to end connected lottery tickets which are adapted to be removed through a gap between the drawer and the housing when the drawer is secured in the housing.

13. A modular display and dispensing assembly for the sale of tickets from a stack of tickets, the assembly comprising:

a base adapted to be securely mounted to a substrate at a prescribed display and dispensing location on the substrate; and at least one display and dispensing module for mounting on the base;

each display and dispensing module including:

a housing for mounting on the base; and a drawer for holding the stack of tickets for sale, the drawer adapted to be removably positioned and secured in the housing for dispensing the tickets for sale from a front of the housing while the entirety of the drawer is secured in the housing, with no portion of the drawer removed from the housing;

each drawer including at least one adjustable divider for varying at least one compartment size in the drawer for holding different size tickets for sale;

wherein the at least one adjustable divider includes a first divider extending transversely of the drawer for adapting to different length tickets in the drawer and positioned rearwardly of the stack of tickets;

wherein the first divider includes a plurality of serrations along a surface thereof for aiding in separation of the tickets to be dispensed from the drawer while the drawer is secured in the housing, with the serrations positioned rearwardly of the stack of tickets to be dispensed and at a rear portion of the drawer, opposite to a forward end of the housing where the tickets are removed.

14. A modular display and dispensing assembly according to claim 13, wherein the drawer includes opposite side walls having a plurality of aligned, vertically extending slots for receiving side edges of the first divider therein.

15. A modular display and dispensing assembly according to claim 14, wherein each side edge of the first divider includes a retaining tab at an upper end thereof, and the drawer includes deeper recesses above the vertically extending slots for receiving the retaining tabs therein to releasably lock the first divider to the drawer at a desired position.

16. A modular display and dispensing assembly for the sale of tickets from a stack of tickets, the assembly comprising:

a base adapted to be securely mounted to a substrate at a prescribed display and dispensing location on the substrate; and at least one display and dispensing module for mounting on the base;

each display and dispensing module including:

a housing for mounting on the base; and a drawer for holding the stack of tickets for sale, the drawer adapted to be removably positioned and secured in the housing for dispensing the tickets for sale from a front of the housing while the entirety of the drawer is secured in the housing, with no portion of the drawer removed from the housing;

each drawer including at least one adjustable divider for varying at least one compartment size in the drawer for holding different size tickets for sale;

wherein the at least one adjustable divider includes a first divider extending transversely of the drawer for adapting to different length tickets in the drawer and positioned rearwardly of the stack of tickets;

wherein the first divider includes at least one ramp at a lower end thereof for aiding in the removal of the tickets from the drawer, with the ramp positioned rearwardly of the stack of tickets to be dispensed and at a rear portion of the drawer, opposite to a forward end of the housing where the tickets are removed.

* * * * *